US009299297B2

(12) United States Patent
Shibamiya et al.

(10) Patent No.: US 9,299,297 B2
(45) Date of Patent: Mar. 29, 2016

(54) IMAGE DISPLAY APPARATUS AND METHOD FOR CONTROLLING THE SAME

(75) Inventors: Yoshikazu Shibamiya, Tokyo (JP); Chika Masuda, Sagamihara (JP); Atsushi Morita, Yokohama (JP); Joji Kamahara, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 227 days.

(21) Appl. No.: 14/238,343

(22) PCT Filed: Sep. 5, 2012

(86) PCT No.: PCT/JP2012/005610

§ 371 (c)(1),
(2), (4) Date: Feb. 11, 2014

(87) PCT Pub. No.: WO2013/035315

PCT Pub. Date: Mar. 14, 2013

(65) Prior Publication Data

US 2014/0198123 A1 Jul. 17, 2014

(30) Foreign Application Priority Data

Sep. 5, 2011 (JP) ..... 2011-192825
Aug. 20, 2012 (JP) ..... 2012-181826
Aug. 31, 2012 (JP) ..... 2012-191713

(51) Int. Cl.
*G09G 5/10* (2006.01)
*G09G 3/36* (2006.01)
*G09G 3/34* (2006.01)

(52) U.S. Cl.
CPC ..... *G09G 3/36* (2013.01); *G09G 3/3426* (2013.01); *G09G 2320/0646* (2013.01); *G09G 2320/103* (2013.01); *G09G 2360/16* (2013.01)

(58) Field of Classification Search
CPC ..... G09G 3/3406; G09G 3/3426; G09G 2320/0626; G09G 2320/064; G09G 2320/0646; G09G 2360/16
See application file for complete search history.

(56) References Cited

U.S. PATENT DOCUMENTS 8,665,298 B2 * 3/2014 Hong ..... G09G 3/3426 345/102
2007/0052661 A1 * 3/2007 Shikata ..... G09G 3/3611 345/102

(Continued)

FOREIGN PATENT DOCUMENTS

JP 2002-006815 A 1/2002
JP 2009-175415 A 8/2009

(Continued)

OTHER PUBLICATIONS

PCT/IB/326 (PCT Notification Concerning Transmittal of International Preliminary Report on Patentability).

(Continued)

*Primary Examiner* — Joe H Cheng
(74) *Attorney, Agent, or Firm* — Cowan, Liebowitz & Latman, P.C.

(57) ABSTRACT

The present invention resides in an image display apparatus for displaying an image on the basis of image data; the image display apparatus comprising light emitting unit having a plurality of light sources for performing light emission that can be independently controlled respectively; setting unit which sets light emission control blocks for controlling one light source or the plurality of light sources with a common brightness; brightness determining unit which determines the light emission brightness of each of the light emission control blocks on the basis of the image data; and control unit which controls the light emission of the light emitting unit for each of the light emission control blocks in accordance with the light emission brightness determined by the determining unit; wherein the setting unit sets a size of the light emission control block of the light emitting unit depending on an amount of motion of the image.

16 Claims, 18 Drawing Sheets

(56) References Cited

U.S. PATENT DOCUMENTS

2009/0109165 A1* 4/2009 Park ..... G09G 3/3426 345/102
2009/0135318 A1* 5/2009 Tateuchi ..... G02F 1/13338 349/12
2009/0303171 A1* 12/2009 Chang ..... G09G 3/3426 345/102
2010/0066752 A1* 3/2010 Watanuki ..... G09G 3/3426 345/589
2010/0295879 A1* 11/2010 Tanaka ..... G09G 3/3426 345/690
2011/0169873 A1* 7/2011 Sano ..... G09G 3/3426 345/690
2012/0113164 A1* 5/2012 Furukawa ..... G09G 3/3426 345/690
2012/0268350 A1* 10/2012 Yoshimura ..... G09G 3/3426 345/1.3
2014/0085360 A1* 3/2014 Ohno ..... G09G 3/3426 345/694
2014/0232764 A1* 8/2014 Nishio ..... G09G 3/3426 345/690
2014/0240201 A1* 8/2014 Takahashi ..... G06F 3/1446 345/1.3
2014/0340429 A1* 11/2014 Inamura ..... G09G 3/34 345/690

FOREIGN PATENT DOCUMENTS

JP 2010-122669 A 6/2010
WO 2011-039996 A1 4/2011
WO 2011-040011 A1 4/2011

OTHER PUBLICATIONS

PCT/IB/373 (PCT International Preliminary Report on Patentability).
PCT/ISA/237 (PCT Written Opinion of the International Searching Authority).

* cited by examiner

| NUMBER OF PIXELS / NUMBER OF DIVISIONS | Res1 | Res2 | | Res(q) | | Res(Q) |
|---|---|---|---|---|---|---|
| | 640x480 | 720x480 | ····· | 1440x960 | ····· | 1920x1080 |
| 480 x 270 | t_1_1 | t_1_2 | : | t_1_q | : | t_1_Q |
| 240 x 135 | t_2_1 | t_2_2 | : | t_2_q | : | t_2_Q |
| : | : | : | : | : | : | : |
| DIVup3 | t_p_1 | t_p_2 | : | t_p_q | : | t_p_Q |
| DIVup2 | t_p+1_1 | t_p+1_2 | : | t_p+1_q | : | t_p+1_Q |
| DIVup1 | t_p+2_1 | t_p+2_2 | : | t_p+2_q | : | t_p+2_Q |
| DIV(i) | t_p+3_1 | t_p+3_2 | : | t_p+3_q | : | t_p+3_Q |
| DIVdn1 | t_p+4_1 | t_p+4_2 | : | t_p+4_q | : | t_p+4_Q |
| : | : | : | : | : | : | : |
| 16 x 9 | t_P-1_1 | t_P-1_2 | : | t_P-1_q | : | t_P-1_Q-1 |
| 1 x 1 | t_P_1 | t_P_2 | : | t_P_q | : | t_P_Q |

*Fig.2*

IMAGE DISPLAY APPARATUS AND METHOD FOR CONTROLLING THE SAME

CROSS-REFERENCE TO RELATED APPLICATIONS

This application is a national stage application of International Application No. PCT/JP2012/005610, filed Sep. 5, 2012, whose benefit is claimed and which claims the benefit of Japanese Patent Applications Nos. 2011-192825, filed Sep. 5, 2011; 2012-191713, filed Aug. 31, 2012 and 2012-181826, filed Aug. 20, 2012, the entire disclosures of which are incorporated herein by reference.

TECHNICAL FIELD

The present invention relates to an image display apparatus and a method for controlling the same.

BACKGROUND ART

A display apparatus, in which a screen image is displayed by adjusting the transmission amount of the light emitted from a backlight, as exemplified by a liquid crystal display apparatus, undergoes the occurrence of such a phenomenon called "misadjusted black level" that even a portion, at which the black is intended to be expressed, seems to be bright, and this phenomenon brings about a factor to deteriorate or decrease the image quality (deteriorate or decrease the contrast) in some cases. This phenomenon occurs such that a liquid crystal unit, which adjusts the transmission amount of the light emitted from the backlight, cannot shut off the light sufficiently, and a part of the light is consequently transmitted.

In view of the above, the following technique is used. That is, the backlight is divided into a plurality of light source blocks. The screen image is analyzed for each of areas (divided areas) on a liquid crystal panel corresponding to the light source blocks respectively. The light emission is controlled for each of the light source blocks depending on the luminance (brightness) of the screen image to be displayed on each of the divided areas. This technique is referred to as the local dimming (hereinafter abbreviated as "LD") control. In accordance with LD, it is possible to display the dark portion more darkly by locally decreasing the luminance of the light source block corresponding to the divided area on which the screen image having the low luminance is displayed, and thus it is possible to suppress the decrease in the contrast.

A technique is disclosed in Japanese Patent Application Laid-open No. 2010-122669 as a conventional technique relevant to the LD control, wherein a still image portion and a moving image portion, which are included in an image, are detected, and the light emission state of a backlight is controlled differently between the still image portion and the moving image portion. In the case of Japanese Patent Application Laid-open No. 2010-122669, the light emission amount is decreased as far as possible in the divided area of the backlight corresponding to the still image portion, and the light emission amount is unchanged as far as possible in the divided area of the backlight corresponding to the moving image portion.

CITATION LIST

Patent Literature

[PTL 1]
Japanese Patent Application Laid-open No. 2010-122669

SUMMARY OF INVENTION

Technical Problem

In the case of the LD control as described above, the smaller the number of the divisions of the backlight by the light source blocks is (the smaller the number of the light source blocks is), the higher the possibility to cause the uneven luminance in the display is, on account of the difference in the luminance at the boundary between the divided areas. In the case of the moving image in which a large amount of motion is present, the displayed image is successively changed, and hence the uneven luminance is hardly noticed by the audience. However, in the case of the still image such as a photograph, an advertisement or the like as well as the moving image in which a small amount of motion is present, the displayed image is changed in a small amount, and hence the uneven luminance is easily noticed by the audience. In order to suppress the decrease or deterioration of the image quality caused by the uneven luminance as described above, it is effective to increase the number of divisions of the backlight (increase the number of light source blocks) in the LD control.

However, if the number of divisions of the backlight is increased in the LD control, the amount of processing is increased, for example, in relation to the analysis of the screen image of each of the divided areas and the determination of the light emission amount of each of the light source blocks. Therefore, the so-called delay time, which is the time ranging from the input of the image data into the image display apparatus to the display on the liquid crystal panel, is prolonged. When the contents such as those of the game or the like, in which the audience performs the interactive operation with respect to the screen image, are displayed, it is preferable that the delay time is short.

An object of the present invention is to provide a technique which simultaneously attains both of the improvement in the quality of a displayed image to be achieved by suppressing the uneven luminance of the displayed image and the suppression of the delay ranging from the input to the display in an image display apparatus in which the local dimming control is performed.

Solution to Problem

The present invention resides in an image display apparatus for displaying an image on the basis of image data, the image display apparatus comprising:

- light emitting unit which has a plurality of light sources for performing light emission that can be independently controlled respectively;
- setting unit which sets light emission control blocks for controlling one light source or the plurality of light sources with a common light emission brightness;
- brightness determining unit which determines the light emission brightness of each of the light emission control blocks on the basis of the image data; and
- control unit which controls the light emission of the light emitting unit for each of the light emission control blocks in accordance with the light emission brightness determined by the brightness determining unit, wherein:
- the setting unit sets a size of the light emission control block of the light emitting unit depending on an amount of motion of the image.

The present invention resides in a control method for controlling an image display apparatus comprising light emitting unit which has a plurality of light sources for performing light emission that can be independently controlled respectively, for displaying an image on the basis of image data, the control method comprising:

a setting step of setting light emission control blocks for controlling one light source or the plurality of light sources with a common light emission brightness;

a brightness determining step of determining the light emission brightness of each of the light emission control blocks on the basis of the image data; and a control step of controlling the light emission of the light emitting unit for each of the light emission control blocks in accordance with the light emission brightness determined by the brightness determining step, wherein:

a size of the light emission control block of the light emitting unit is set depending on an amount of motion of the image in the setting step.

Advantageous Effects of Invention

According to the present invention, it is possible to simultaneously attain both of the improvement in the quality of a displayed image to be achieved by suppressing the uneven luminance of the displayed image and the suppression of the delay ranging from the input to the display in the image display apparatus which performs the local dimming control.

Further features of the present invention will become apparent from the following description of exemplary embodiments with reference to the attached drawings.

BRIEF DESCRIPTION OF DRAWINGS

FIG. 2 illustrates a number of block divisions table in the first embodiment.

DESCRIPTION OF EMBODIMENTS

First Embodiment

Figure 1:
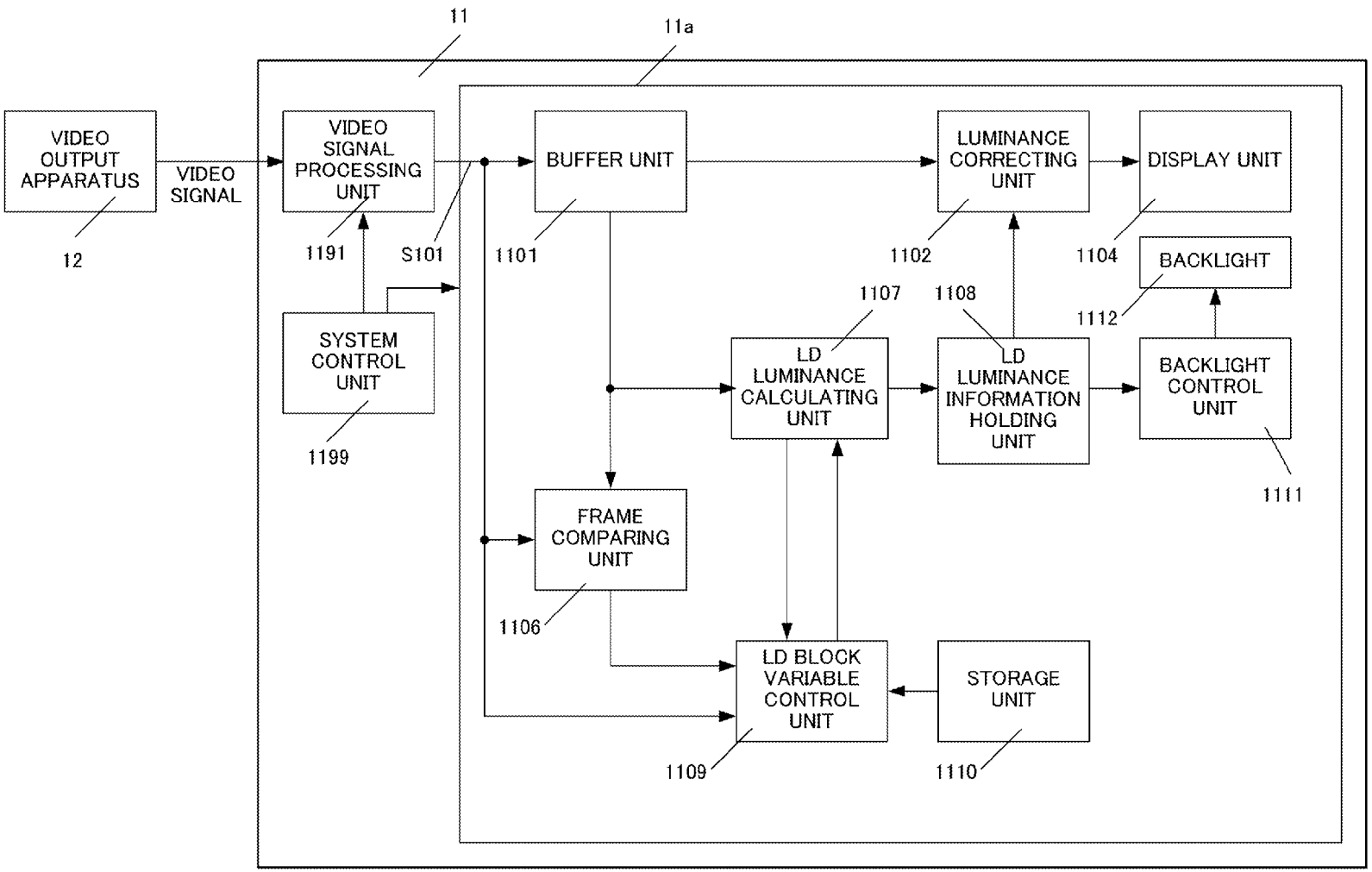
FIG. 1 shows a block diagram in relation to a first embodiment.

FIG. 1 shows a schematic arrangement of an image display apparatus according to a first embodiment of the present invention. With reference to FIG. 1, the image display apparatus 11 comprises a video signal processing unit 1191, a system control unit 1199, a local dimming (hereinafter referred to as "LD") control device (controller) 11*a*, a display unit 1104, and a backlight 1112 (light emitting unit). The image display apparatus 11 displays a screen image (picture) on the basis of the video signal (image data) inputted from a video output apparatus 12. The video output apparatus 12 is, for example, PC (personal computer) or a DVD player.

The backlight 1112 is divided into a plurality of light source blocks for which the light emission can be controlled independently. In this embodiment, the light emission of the backlight 1112 is controlled in units of LD blocks (light emission control blocks) each composed of one or more light source blocks. In other words, as shown in a left drawing in FIG. 7 as described later on, the backlight 1112 is divided into two or more LD blocks, and the light emission is controlled independently for each of the LD blocks (for each of the light emission control blocks). The way of division, in accordance with which the backlight 1112 is divided on the basis of the LD blocks, is changeable or variable.

The display unit 1104 is a display instrument based on the use of a transmission type liquid crystal panel. In this embodiment, the numbers of pixels are 1920 pixels for the width× 1080 pixels for the height. The display unit 1104 displays the screen image such that the inputted video data is successively written into the liquid crystal and the transmittance of the light emitted from the backlight 1112 is regulated for each of the pixels. The display area of the display unit 1104 is divided by two or more divided areas corresponding to the respective LD blocks as the units for controlling the light emission of the backlight 1112. Therefore, the way of division, which is based on the divided areas of the display unit 1104, is changeable or variable in accordance with the way of division which is based on the LD blocks of the backlight 1112.

The LD control device (controller) 11*a* has a buffer unit 1101 which temporarily holds or retains the inputted video data in units of frames and which outputs the held or retained frame image data to a luminance correcting unit 1102, a frame comparing unit 1106, and an LD luminance calculating unit 1107 (brightness determining unit).

The luminance correcting unit 1102 corrects the luminance (brightness) of the frame image data inputted from the buffer unit 1101 for each of the divided areas on the basis of the LD luminance information as the information of the LD luminance (light emission luminance (light emission brightness)) of each of the LD blocks inputted from an LD luminance information holding unit 1108, and the obtained result is outputted to the display unit 1104. The luminance correcting unit 1102 performs the correction to raise the light emission luminance, for example, with respect to the pixel data of the divided area corresponding to the LD block having the low LD luminance so that the image is displayed thereby at the light emission luminance as assumed in relation to the original frame image data.

The frame comparing unit 1106 compares the frame image data inputted from the video signal processing unit 1191 with the temporarily held frame image data inputted from the buffer unit 1101 to judge whether or not the both are identical with each other. A judgment result is outputted to an LD block variable control unit 1109 (setting unit). Specifically, the pixel values of the frame image data of the both are compared with each other in units of pixels. If the number of pixels in which the pixel values are changed (amount of motion of the image) is not more than a predetermined threshold value A in relation to the entire frame image data, it is possible to judge that the image is the still image. If the number of pixels is larger than the predetermined threshold value A, it is possible to judge that the image is the moving image. In other words, in this embodiment, it is judged whether the image is either the moving image or the still image on the basis of the amount of motion of the image. Theoretically, if the image is the still image, then the number of pixels in which the pixel values are changed between the temporally adjoining two pieces of the frame image data (between the frames) is zero, and the threshold value A should be zero. However, even in the case of the still image, any pixel, in which the pixel value is changed between the frames, exists in some cases on account of any external factor caused, for example, by the noise generated in the image display apparatus itself and/or the quality of the cable for connecting the image display apparatus 11 and the video output apparatus 12 to be used when the video signal is inputted. Tasking such situations into consideration, it is preferable that the predetermined threshold value A is set to be larger than zero.

The LD luminance calculating unit 1107 calculates and determines the light emission luminance of each of the light emission control blocks (each of the LD blocks) on the basis of the frame image data. Specifically, the information of the number of divisions based on the LD blocks (referred to as "number of block divisions") of the backlight 1112 is inputted from the LD block variable control unit 1109 into the LD luminance calculating unit 1107, and the LD luminance calculating unit 1107 analyzes the frame image data read from the buffer unit 1101 for each of the divided areas. The LD luminance calculating unit 1107 calculates the luminance of each of the divided areas, for example, by means of the histogram calculation to determine the light emission luminance (LD luminance) of the LD block corresponding to each of the divided areas depending on the luminance of each of the divided areas. The LD luminance calculating unit 1107 outputs the information of the determined LD luminance (LD luminance information) to the LD luminance information holding unit 1108. Further, the LD luminance calculating unit 1107 outputs, to the LD block variable control unit 1109, the information of the number of LD blocks for which the calculation of the LD luminance is completed when one frame elapses after the start of the calculation of the LD luminance of a certain frame (referred to as "number of LD luminance calculation-completed blocks). Further, the LD luminance calculating unit 1107 outputs, to the LD block variable control unit 1109, the completion notification provided when the calculation of the LD luminance is completed for the certain frame.

The LD luminance information holding unit 1108 temporarily stores the LD luminance information inputted from the LD luminance calculating unit 1107. The LD luminance information holding unit 1108 outputs the latest LD luminance information inputted from the LD luminance calculating unit 1107 to the luminance correcting unit 1102 and the backlight control unit 1111 (control unit).

It is now assumed that the LD luminance information holding unit 1108 holds the LD luminance information LD0 which is calculated by the LD luminance calculating unit 1107 with the number of block divisions DIV0 for a certain frame 0.

If a frame 1 next to the frame 0 is not identical with the frame 0 (in the case of the moving image data), the LD luminance information holding unit 1108 acquires and holds the LD luminance information LD1 calculated with the number of block divisions DIV1 by the LD luminance calculating unit 1107 for the frame 1. The LD luminance information holding unit 1108 outputs the acquired LD luminance information LD1 to the luminance correcting unit 1102 and the backlight control unit 1111.

On the other hand, if the frame 1 next to the frame 0 is identical with the frame 0 (in the case of the still image data), the LD luminance information holding unit 1108 is operated in the following two ways.

If the LD luminance calculating unit 1107 completes the calculation of the LD luminance information LD2 with the second number of block divisions DIV2 which is larger than the first number of block divisions DIV1, in relation to the frame 1, the LD luminance information holding unit 1108 acquires and holds the LD luminance information LD2. The LD luminance information holding unit 1108 outputs the acquired LD luminance information LD2 to the luminance correcting unit 1102 and the backlight control unit 1111.

On the other hand, if the LD luminance calculating unit 1107 does not complete the calculation of the LD luminance information LD2 with the second number of block divisions DIV2 in relation to the frame 1, the following operation is performed. That is, the LD luminance information holding unit 1108 outputs the holding LD luminance information LD0 to the luminance correcting unit 1102 and the backlight control unit 1111 during a period until the calculation of the LD luminance information LD2 with the second number of block divisions DIV 2 is completed.

The LD block variable control unit 1109 can change the number of block divisions as the number of LD blocks with which the backlight 1112 is divided. In other words, the LD block variable control unit 1109 performs the setting of the light emission control block or blocks so that one light source or the plurality of light sources are controlled with the common light emission luminance. In order to determine the initial value of the number of block divisions, the LD block variable control unit 1109 detects the frame cycle and the number of pixels of the video data S101 inputted from the video signal processing unit 1191. If the delay time is, for example, two frames, the LD block variable control unit 1109 determines the number of block divisions so that the calculation of the LD luminance can be completed within two frames from the input, on the basis of the detected number of pixels and the frame cycle. The LD block variable control unit 1109 determines the predetermined number of block divisions to be applied when the moving image data is displayed. The delay time is the time until display is performed after the frame image data is inputted. The LD block variable control unit 1109 holds the determined number of block divisions as the latest number of block divisions which is outputted to the LD luminance calculating unit 1107. The LD block variable control unit 1109 determines the number of block divisions corresponding to the number of pixels and the frame cycle of the inputted video data, by making reference to a number of block divisions table (described later on) stored in a storage unit 1110.

The LD block variable control unit 1109 acquires, from the frame comparing unit 1106, the judgment result to show whether or not the frame image data of the present frame inputted from the video signal processing unit 1191 is identical with the frame image data of the previous frame inputted from the buffer unit 1101. The LD block variable control unit 1109 judges whether or not the number of block divisions is required to be changed depending on the acquired judgment result. Specifically, the LD block variable control unit 1109 increases the number of block divisions if the present frame is identical with the previous frame. The LD block variable control unit 1109 does not change the number of block divisions if the present frame is different from the previous frame. If the LD block variable control unit 1109 judges that the number of block divisions is required to be changed, then the LD block variable control unit 1109 determines the latest number of block divisions on the basis of the number of block divisions table, and the latest number of block divisions is held and outputted to the LD luminance calculating unit 1107.

The LD block variable control unit 1109 acquires, from the LD luminance calculating unit 1107, the information of the number of LD blocks which are included in the LD blocks of the concerning frame and for which the calculation of the LD luminance has been completed, when one frame elapses after the start of the calculation of the LD luminance of the certain frame. The LD block variable control unit 1109 corrects the number of block divisions, if necessary, on the basis of the number of block divisions table so that the calculation of the LD luminance can be completed with one remaining frame, depending on the number of LD blocks for which the calculation of the LD luminance is not completed yet when one frame elapses.

Specifically, if the number of LD luminance calculation-completed blocks upon the elapse of one frame is not less than a half of the number of block divisions, the LD block variable control unit 1109 does not correct the number of block divisions. In any case other than the above, the LD block variable control unit 1109 performs the correction to decrease the number of block divisions so that the calculation of the LD luminance can be completed within one remaining frame. Details will be described later on. The LD block variable control unit 1109 outputs the information of the corrected number of block divisions to the LD luminance calculating unit 1107. Further, the LD block variable control unit 1109 determines the number of block divisions to be applied to the next frame on the basis of the number of block divisions table. The latest number of block divisions is updated and held, which is outputted to the LD luminance calculating unit 1107.

The number of block divisions table is the table which represents the correlation among the number of pixels of the frame image data, the number of block divisions, and the maximum value assumed as the time required to complete the calculating process for calculating the LD luminance. FIG. 2 shows an example of the number of block divisions table. In FIG. 2, the leftmost column represents the number of block divisions available in this image display apparatus, and the uppermost raw represents the number of pixels of the frame image data. For example, if the number of pixels resides in 1920 pixels for the width×1080 pixels for the height, and the number of block divisions resides in 32400 divisions of 240 for the width×135 for the height, then the maximum value, which is assumed as the time required to complete the calculating process for the LD luminance, is t_2_Q. Details will be described later on.

The LD luminance information is inputted from the LD luminance information holding unit 1108 into the backlight control unit 1111. The backlight control unit 1111 controls the light emission of the backlight 1112 for each of the LD blocks on the basis of the LD luminance information.

The backlight 1112 is arranged at the back surface of the display unit 1104. The backlight 1112 is the direct type backlight in which LED is used as the light source (light-emitting element). The light emission of each of the plurality of light source blocks for constructing the backlight 1112 is controlled independently by the backlight control unit 1111. Each of the light source blocks is composed of one or more LEDs. LEDs, which belong to the identical light source block, are connected in series or in parallel, and LEDs emit the light in accordance with the identical control signal (for example, PWM signal having an identical cycle and an identical duty ratio). The writing of the luminance data into LED is performed by means of the line scanning control having been hitherto known. In the line scanning, a plurality of lines can be simultaneously subjected to the scanning. When the division based on the LD blocks is rough (if the number of block divisions is small and the individual LD blocks are large), the LED writing time can be shortened by simultaneously scanning the plurality of lines. In this embodiment, the backlight 1112 is divided into 129600 light source blocks in total of 480 segments for the width (lateral dimension) and 270 lines for the height (longitudinal dimension). The maximum value of the number of block divisions is the value of 129600 divisions of 480 for the width (lateral dimension)× 270 for the height (longitudinal dimension). In this case, each of the LD blocks is composed of one light source block. The minimum number of block divisions resides in 1 for the width (lateral dimension)×2 for the height (longitudinal dimension) or 2 for the width (lateral dimension)×1 for the height (longitudinal dimension). In this case, the number of LD blocks is two. If the division based on the LD blocks is not performed, the number of LD block is one. It is also appropriate that this LD block is constructed by 129600 light source blocks.

The video signal processing unit 1191 performs various types of image processing other than the LD control for the image display apparatus 11, including, for example, the synchronous control and the processes in relation to, for example, the luminance, the chromaticity, and the number of pixels of the video data.

The system control unit 1199 controls the operation of the entire image display apparatus 11 in an integrated manner. The system control unit 1199 performs, for example, the control of the power source, the switching of the video signal, and the control of the process in response to the operation performed by a user.

The image display apparatus of this embodiment is operated such that the calculation of the LD luminance is completed within two frames with respect to the inputted frame, and the inputted frame is displayed on the display unit 1104 at the timing delayed by two frames.

Figure 3:
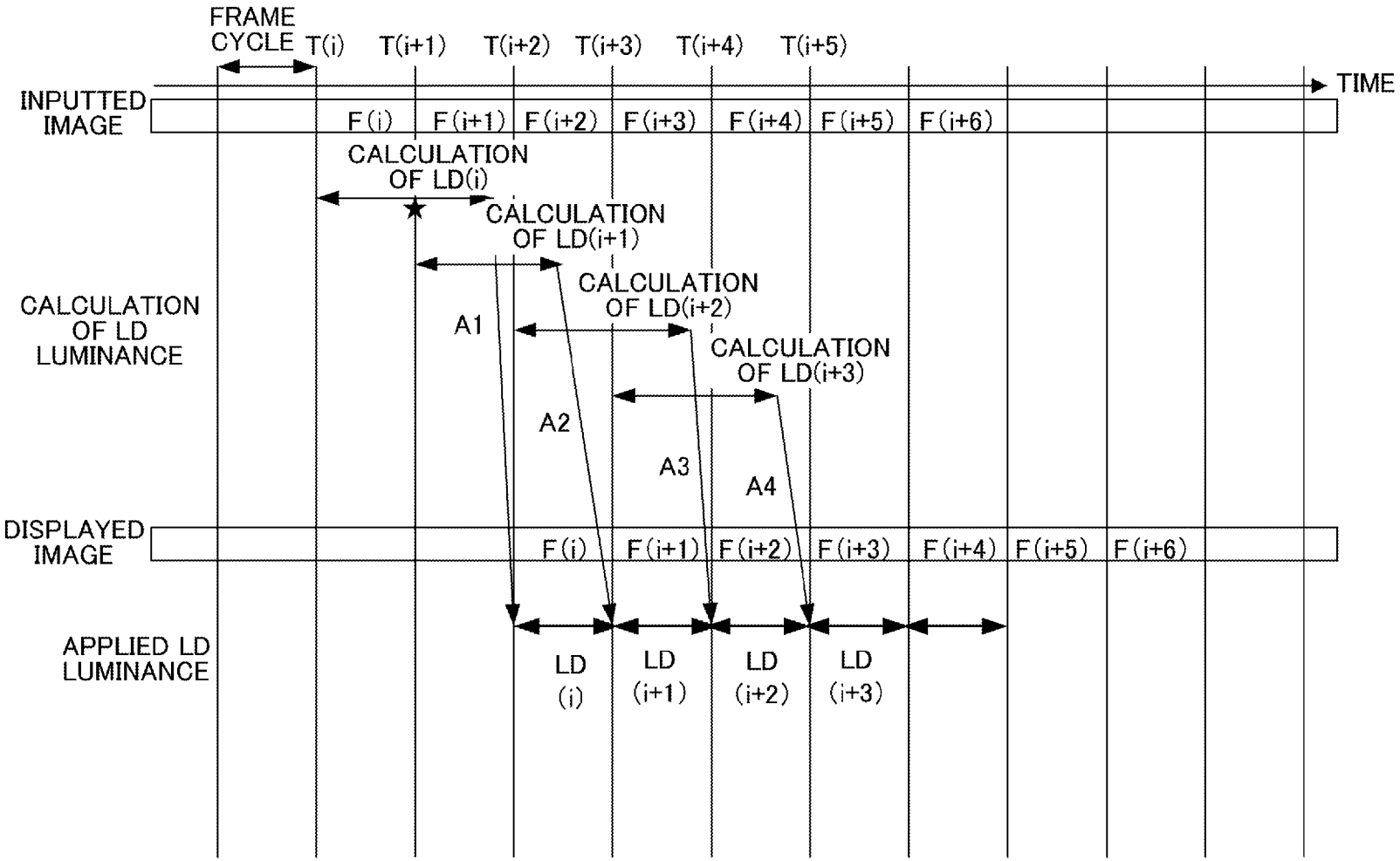
FIG. 3 shows the operation timing in the first embodiment.

FIG. 3 illustrates the timing of the LD control if the two continuous frames are not identical, i.e., if the inputted screen image is the moving image. FIG. 3 shows an example of the case in which the delay from the input to the display is two frames. It is assumed that DIV (i) represents the number of block divisions determined by the LD block variable control unit 1109 as the number of block divisions with which the calculation of the LD luminance information can be completed within two frames when the frame F(i) is inputted. In the example shown in FIG. 3, the LD luminances are calculated within two frames on the basis of the image data of the inputted frame F(i). The display control is performed such that the frame F(i) is displayed in a state in which the backlight 1112 is subjected to the LD control in accordance with the calculated LD luminances, at the timing delayed by two frames.

Figure 4:
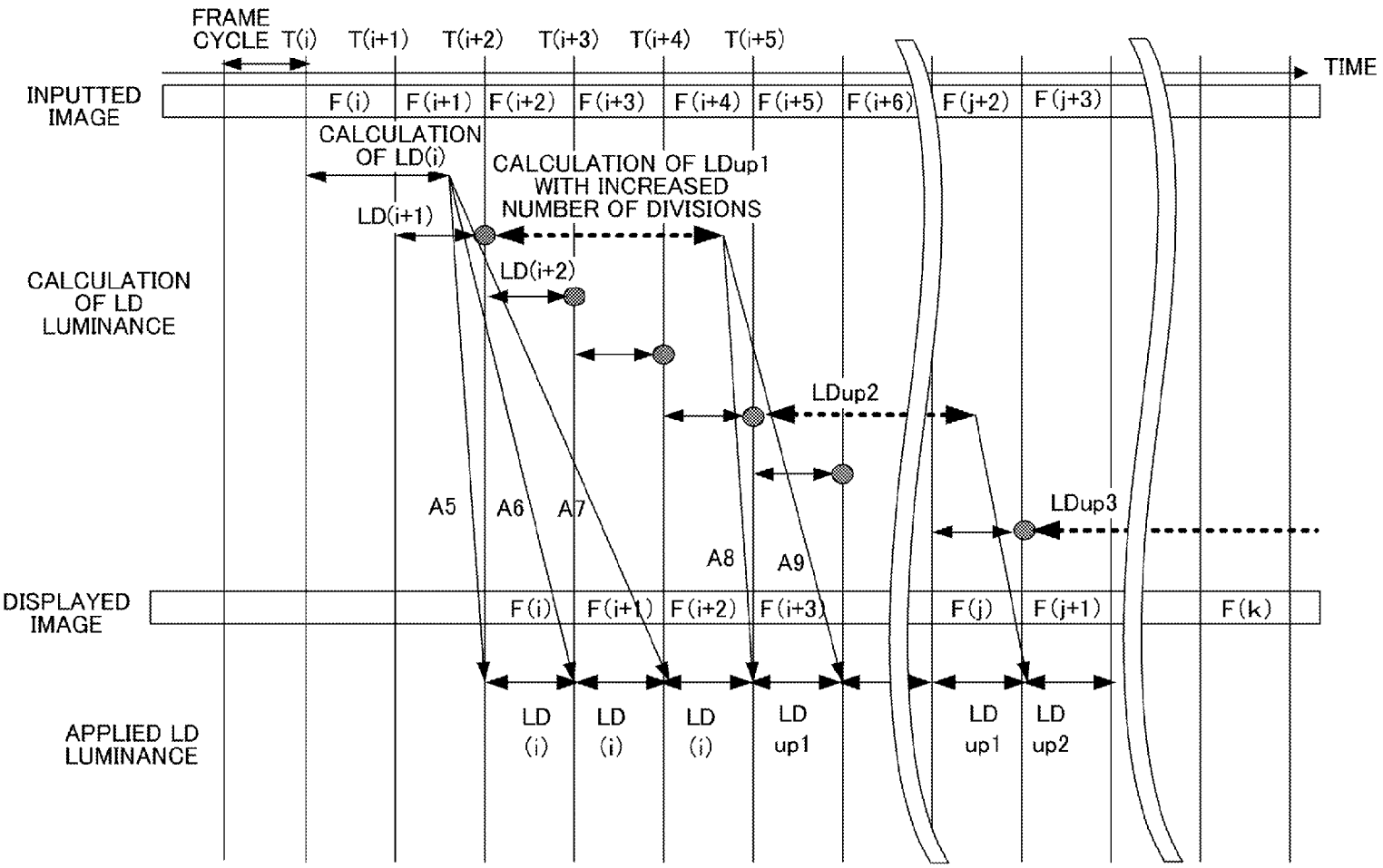
FIG. 4 shows the operation timing in the first embodiment.

FIG. 4 illustrates the timing of the LD control to be performed if the two continuous frames are identical, i.e., if the inputted screen image is the still image or in the still state. It is assumed that DIV(i) represents the number of block divisions determined by the LD block variable control unit 1109 as the number of block divisions with which the calculation of the LD luminance information can be completed within two frames when the frame F(i) is inputted. It is assumed that LD (i) represents the LD luminance adapted to the frame F(i) as calculated by the LD luminance calculating unit 1107. The frame F(i) is displayed in a state in which the backlight 1112 is subjected to the light emission control on the basis of the calculated LD luminance LD(i) at the timing T(i+2) delayed by two frames from the timing T(i) at which the frame F(i) is inputted.

If it is judged that the next frame F(i+1) is identical with the frame F(i), the LD luminance calculating unit 1107 starts the calculation of the LD luminance LDup1 with the number of block divisions DIVup1 in which the number of block divisions DIV(i) is increased by one level. The calculation of the LD luminance LDup1 is performed on the basis of the frame image data of the frame F(i) (=F(i+1)).

The LD luminance information holding unit 1108 outputs the LD luminance LD(i) calculated with the number of block divisions DIV(i) to the luminance correcting unit 1102 and the backlight control unit 1111 until the LD luminance calculating unit 1107 completes the calculation of the LD luminance LDup1 with the number of block divisions DIVup1.

If the LD luminance calculating unit 1107 completes the calculation of the LD luminance LDup1 with the number of block divisions DIVup1, the LD luminance information, which is to be outputted to the luminance correcting unit 1102 and the backlight control unit 1111, is switched into the information of the LD luminance LDup1 by the LD luminance information holding unit 1108.

In the example shown in FIG. 4, the calculation of the LD luminance LDup1 is completed within the display period of the frame F(i+2) (time T(i+4) to time T(i+5)), and the LD luminance LDup1 is applied to those starting from the frame F(i+3) displayed from the time T(i+5).

If the state, in which the inputted frame is identical, is further continued, the LD luminance calculating unit 1107 starts the calculation of the LD luminance LDup2 with the number of block divisions DIVup2 in which the number of block divisions is further increased. If the calculation of the LD luminance LDup2 is completed, the LD luminance information holding unit 1108 switches the LD luminance information to be outputted to the luminance correcting unit 1102 and the backlight control unit 1111 into the information of the LD luminance LDup2.

In the example shown in FIG. 4, the calculation of the LD luminance LDup2 is completed within the display period of the frame F(j), and hence the LD luminance LDup2 is applied to those starting from the display of the frame F(j+1). In this way, if the display of the still image is continued, the process is performed such that the number of block divisions is increased in a stepwise manner as the time elapses. A procedure is also conceived, in which the number of block divisions is increased at once without increasing the number of block divisions in the stepwise manner. However, in such a procedure, for example, the flicker arises due to the sudden luminance change of the displayed image, and any sense of incongruity is given to a user. Therefore, when the number of block divisions is increased in the stepwise manner as the time elapses as described above, then it is possible to suppress the occurrence of any uneven luminance without giving the sense of incongruity to the user, and it is possible to improve the quality of the displayed image. Therefore, in this embodiment, it is preferable that the number of block divisions is increased in the stepwise manner.

Figure 5:
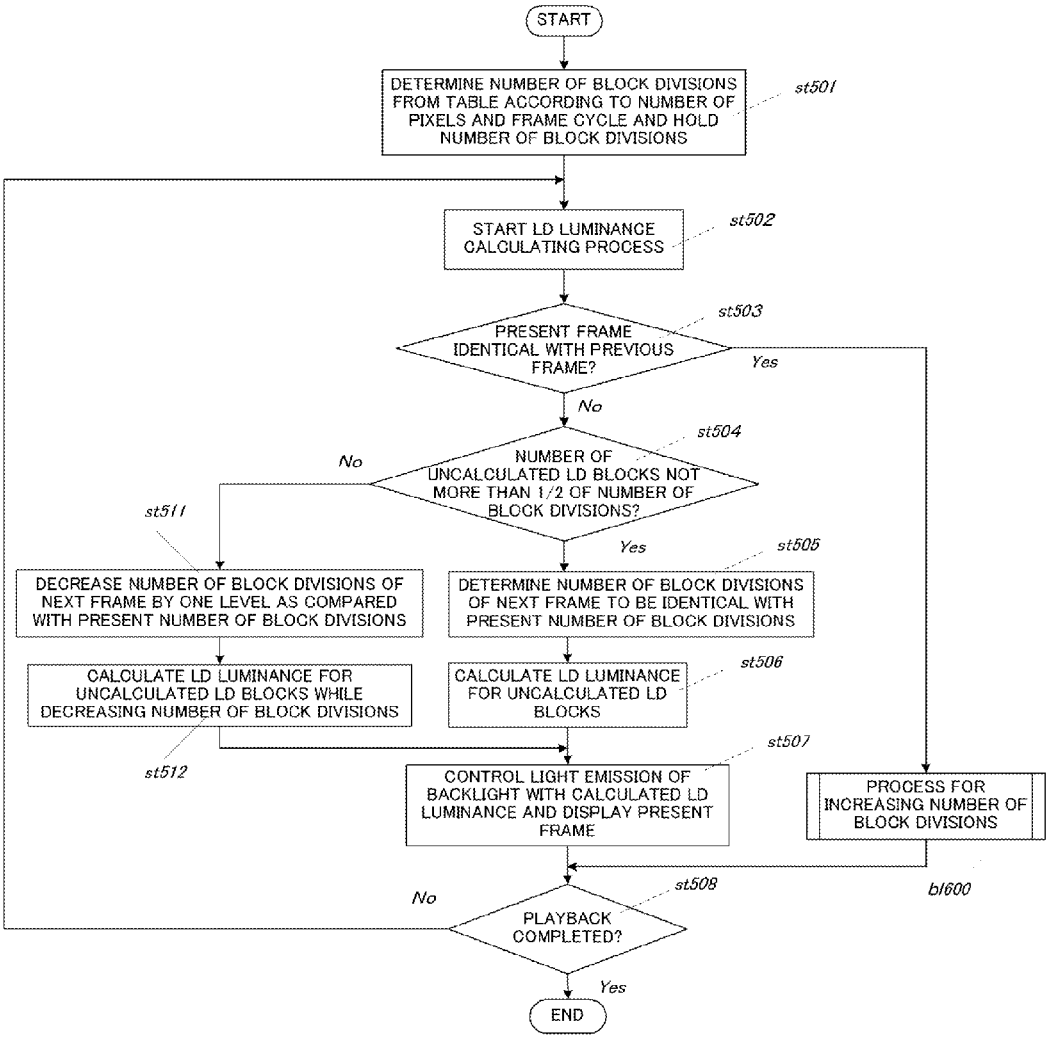
FIG. 5 illustrates the flow of the operation in the first embodiment.
Figure 6:
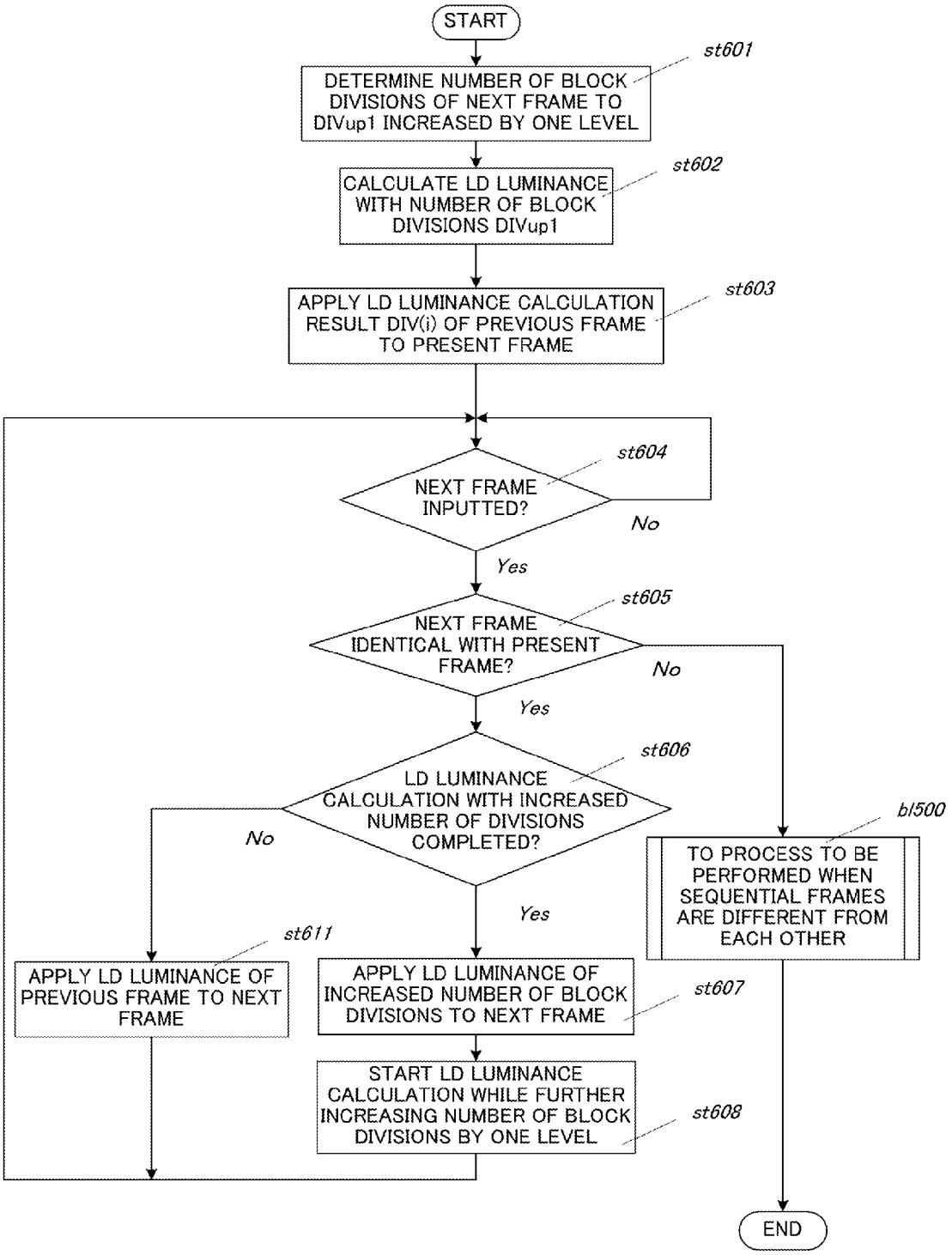
FIG. 6 illustrates the flow of the operation in the first embodiment.
Figure 7:
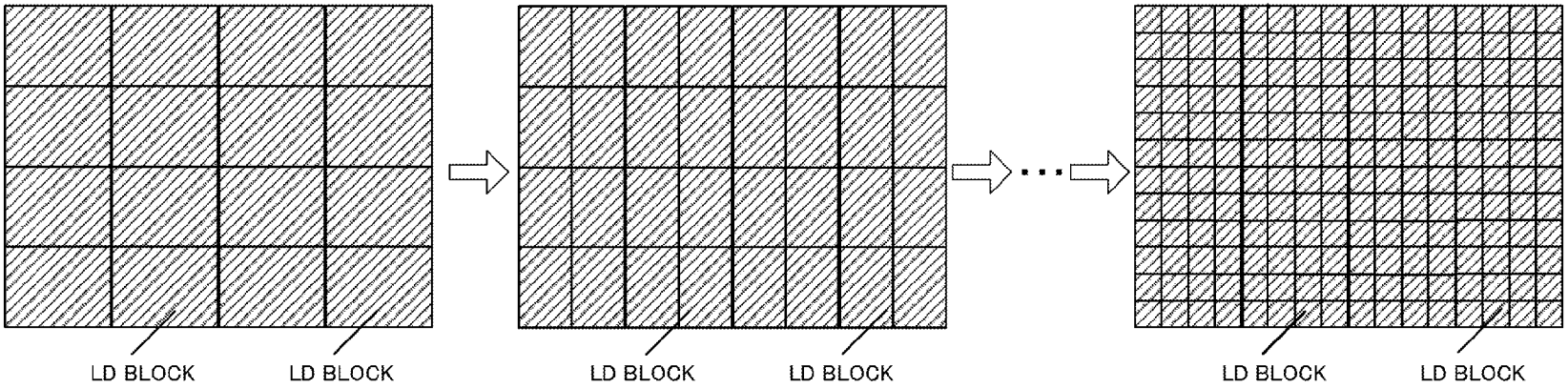
FIG. 7 illustrates the division control for LD blocks in the first embodiment.

FIG. 5 shows a flow of the operation of the image display apparatus of this embodiment if the two continuous frames are not identical, i.e., if the inputted screen image is the moving image. Details will be described later on. FIG. 6 shows a flow of the operation of the image display apparatus of this embodiment if the two continuous frames are identical, i.e., if the inputted screen image is the still image. FIG. 7 illustrates the division control for the LD blocks in the first embodiment. Details will be described later on.

Next, an explanation will be made about the operation of the image display apparatus of this embodiment with reference to FIGS. 2 to 6. It is assumed that the power source of the image display apparatus 11 is turned ON, and the video signal is inputted from the video output apparatus 12. At first, an explanation will be made with reference to FIGS. 3 and 5 about the process to be performed when the two frames, which are inputted continuously, are different from each other.

The LD block variable control unit 1109 detects the number of pixels and the frame cycle of the video data from the inputted video data S101. In this procedure, it is assumed that the number of pixels 1440×960 and the frame cycle Ts are detected. If the frame F(i) is inputted, the LD block variable control unit 1109 retrieves the number of block divisions with which all of the LD luminances can be calculated within a period of time shorter than the delay time (two frames in this procedure) by making reference to the number of block divisions table on the basis of the number of pixels and the frame cycle detected as described above. The LD block variable control unit 1109 outputs the retrieved number of block divisions DIV(i) to the LD luminance calculating unit 1107. The delay time is the delay time until the display is performed after the image data of the frame is inputted.

In this procedure, the LD block variable control unit 1109 retrieves the maximum value of the processing time shorter than the time (2×Ts) which is twice the frame cycle, from the column in which the number of pixels is 1440×960 in the number of block divisions table shown in FIG. 2. In this procedure, it is assumed that the maximum value of the processing time shorter than 2×Ts is t_p+3_q. In this case, the LD block variable control unit 1109 determines the number of block divisions corresponding to the processing time t_p+3_q as the number of block divisions DIV(i) to be applied to the frame F(i), and the number of block divisions is held as the latest number of block divisions (st501).

The LD luminance calculating unit 1107 analyzes the image data of the frame F(i) read from the buffer unit 1101 in units of divided areas to progressively calculate the LD luminance information LD(i) with the number of block divisions DIV(i) (st502).

The frame comparing unit 1106 performs a comparing process in order to judge whether or not the frame image data of the inputted video signal is identical with the frame image data of one frame ago, concurrently with the calculating process for calculating the LD luminance performed by the LD luminance calculating unit 1107. The frame comparing unit 1106 judges whether or not the present frame is identical with the frame of one frame ago at the point in time T(i+1) at which the input of the frame image data is completed (st503).

If it is judged in st503 that the present frame is identical with the frame of one frame ago, i.e., if the image is the still image in which the screen image involves no motion, then the routine transits to a process for increasing the number of block divisions as described later on (bl600).

If it is judged in st503 that the present frame is not identical with the frame of one frame ago (in the case of the moving image in which the screen image involves the motion), then the LD block variable control unit 1109 judges whether or not the calculation of the LD luminance LD(i) of the frame F(i) can be actually completed within two frames. The LD block variable control unit 1109 acquires the number of blocks for which the calculation of the LD luminance has been completed, from the LD luminance calculating unit 1107 at the point in time T(i+1) at which a predetermined period of time (one frame in this case) has elapsed after the start of the calculation of the LD luminance LD(i), and the progress status of the calculation of the LD luminance LD(i) is confirmed.

In this procedure, the LD block variable control unit 1109 judges whether or not the number of blocks for which the calculation of the LD luminance has been completed is not less than a half of the number of block divisions DIV(i) (st504). In other words, it is judged whether or not the number of uncalculated LD blocks (uncalculated light emission control blocks) for which the calculation of the LD luminance has not been completed is less than a threshold value (less than a half of the number of block divisions DIV(i) in this case) (whether or not the number of uncalculated LD blocks is less than ½).

If the number of uncalculated LD blocks is less than ½ of the number of block divisions at the point in time at which one frame elapses after the start of the calculation of the LD luminance, the LD block variable control unit 1109 judges that the LD luminance can be calculated for the uncalculated LD blocks within one remaining frame. The LD luminance calculating unit 1107 continues the calculation of the LD luminance for the uncalculated LD blocks, and the number of block divisions DIV(i), which has been applied to the frame F(i), is set as the number of block divisions which is to be applied to the next frame F(i+1). The LD luminance calculating unit 1107 starts the calculation of the LD luminance LD(i+1) on the basis of the image data of the next frame F(i+1) (st505). Further, the LD luminance calculating unit 1107 executes the calculation of the LD luminance for the uncalculated LD blocks, the LD luminance being included in the LD luminance LD(i) to be applied to the frame F(i) (st506).

On the other hand, if the number of uncalculated LD blocks is not less than ½ of the number of block divisions at the point in time at which one frame elapses after the start of the calculation of the LD luminance, the LD block variable control unit 1109 judges that the LD luminance cannot be calculated for the uncalculated LD blocks within one remaining frame with the initial number of block divisions. In this case, the LD block variable control unit 1109 redivides the area of the backlight 1112 corresponding to the uncalculated LD blocks with the LD blocks of a number smaller than the number of uncalculated LD blocks. In other words, the LD block variable control unit 1109 increases the size of the uncalculated LD blocks. The LD luminance calculating unit 1107 calculates the luminance for new LD blocks brought about by the redivision at and after the point in time at which one frame elapses. In this procedure, the LD block variable control unit 1109 retrieves the number of block divisions which is smaller by one level than the number of block divisions DIV (i) applied to the frame F(i), on the basis of the number of block divisions table. The LD block variable control unit 1109 holds the found number of block divisions (DIVdn1) as the latest number of block divisions. The LD luminance calculating unit 1107 acquires the concerning latest number of block divisions DIVdn1 from the LD block variable control unit 1109, and the concerning latest number of block divisions DIVdn1 is set as the number of block divisions to be applied to the next frame and the followings (F(i+1) and the followings) (st511). Accordingly, the number of block divisions is corrected so that the calculation of the LD luminance for the next frame F(i+1) and the followings is reliably completed within two frames.

Further, the LD block variable control unit 1109 changes the way of division of the area of the backlight 1112 corresponding to the uncalculated LD blocks so that the calculating process for calculating the LD luminance to be applied to the frame F(i) can be completed within one remaining frame. In this procedure, the LD block variable control unit 1109 decreases the number of uncalculated LD blocks by collecting two uncalculated LD blocks adjoining in the lateral direction to provide one new uncalculated LD block. Uncalculated LD blocks, which cannot be collected as two blocks in the lateral direction, are left as they are, for example, when the number of uncalculated LD blocks is an odd number on the basis of the initial number of block divisions DIV(i) or when the number of divisions in the lateral direction is an odd number. The method for changing the way of division of the area of the backlight 1112 corresponding to uncalculated LD blocks is not limited thereto. The LD block variable control unit 1109 outputs the information of the uncalculated LD blocks after the decrease to the LD luminance calculating unit 1107. The LD luminance calculating unit 1107 calculates the LD luminance on the basis of the image data of the frame F(i) for each of the uncalculated LD blocks after the decrease (st512). According to the processes as described above, the control is performed such that the calculation of the LD luminance is completed within two frames after the input of the frame. Therefore, even when the LD control is performed during the period in which the moving image is displayed, it is possible to suppress the delay ranging from the input to the display.

The luminance correcting unit 1102 executes the luminance correcting process for the image data of the frame F(i) concurrently with the calculating process for calculating the LD luminance performed by the LD luminance calculating unit 1107, on the basis of the LD luminance information inputted from the LD luminance information holding unit 1108. If the LD luminance calculating unit 1107 completes the calculation of the LD luminance LD(i), the image data of the frame F(i), which includes the luminance corrected by the luminance correcting unit 1102 on the basis of the information of the LD luminance LD(i), is outputted to the display unit 1104 at T(i+2) delayed by two frames from the input. The backlight control unit 1111 controls the light emission of each of the light source blocks of the backlight 1112 on the basis of the information of the LD luminance LD(i) (A1 in FIG. 3) (st507).

The process as described above is repeated until the completion of playback is instructed in st508.

In this way, in the case of the moving image, the calculation of the LD luminance, which is started from the point in time at which the frame is inputted, is completed within two frames. The image data of the frame is displayed in the state in which the backlight is subjected to the light emission control by using the LD luminance calculated as described above, at the timing delayed by two frames from the input.

Next, an explanation will be made with reference to FIGS. 4 and 6 about the process for increasing the number of block divisions to be executed if it is judged in st503 that the frames are identical with each other, i.e., in the case of the still image in which the screen image involves no motion.

It is assumed that the input of the frame F(i+1) is completed in relation to FIG. 4, and it is judged by the frame comparing unit 1106 that the frame F(i) and the frame F(i+1) are identical with each other at the timing T(i+2). The LD luminance LD(i), which is calculated in accordance with the LD luminance calculating process as performed when the image is the moving image as described above, is applied to the frame F(i) which is provided one frame before the frame F(i+1), and the frame F(i) is displayed while being delayed by two frames from the input timing T(i) (A5 in FIG. 4).

If it is judged that the frame F(i+1) is identical with the frame F(i) provided one frame ago, the LD block variable control unit 1109 acquires, from the number of block divisions table (FIG. 2), the number of block divisions DIVup1 which is increased by one level as compared with the number of block divisions DIV(i) applied to the frame F(i). The LD block variable control unit 1109 outputs the acquired number of block divisions DIVup1 to the LD luminance calculating unit 1107 (st601).

The LD luminance calculating unit 1107 interrupts the process for calculating the LD luminance LD(i+1) for the frame F(i+1) with the number of block divisions DIV(i) subjected to the processing at present, and the LD luminance calculating unit 1107 starts the calculation of the LD luminance LDup1 for the frame F(i+1) with the number of block divisions DIVup1. If the calculation of the LD luminance LDup1 with the number of block divisions DIVup1 is completed, then the LD luminance calculating unit 1107 outputs the completion notification of the LD luminance calculation to the LD block variable control unit 1109, and the calculated LD luminance LDup1 is written into the LD luminance information holding unit 1108 (st602). In FIG. 4, the calculation of the LD luminance LDup1 with the number of block divisions DIVup1 is started from the time T(i+2), and the calculation is completed within the display period (T(i+4) to T(i+5)) of the frame F(i+2).

The LD luminance calculating unit 1107 controls the LD luminance information holding unit 1108 so that the LD luminance LD(i), which has been applied to the frame F(i) of one frame ago, is applied to the frame F(i+1). The LD luminance information holding unit 1108 outputs the LD luminance LD(i) to the backlight control unit 1111 and the luminance correcting unit 1102, and the LD control, which has been applied to the previous frame F(i), is applied to the present frame F(i+1) (st603) (A6 in FIG. 4). Accordingly, the display of the frame F(i+1) is started in a state in which the backlight 1112 is subjected to the LD control at the LD luminance LD(i) at the timing T(i+3) delayed by two frames from the input.

If the input of the next frame F(i+2) is detected (st604: Yes), the LD block variable control unit 1109 acquires the judgment result to indicate whether or not the frame is identical with the previous frame F(i+1), from the frame comparing unit 1106 in the same manner as described above. The LD block variable control unit 1109 judges whether or not the frame F(i+2) is identical with the frame F(i+1) provided one frame ago, on the basis of the acquired judgment result (st605). If the frame F(i+2) is different from the previous frame F(i+1), the routine transits to the LD luminance calculating process to be performed when the image is the moving image as described above (FIGS. 3 and 5) (bl500). In this case, the calculation of the LD luminance is performed for the frame F(i+2) with the number of block divisions acquired from the number of block divisions table depending on the number of pixels of the frame F(i+2) and the frame cycle.

On the other hand, if the frame F(i+2) is identical with the frame F(i+1) provided one frame ago, the LD luminance information holding unit 1108 judges whether or not the calculation of the LD luminance LDup1 with the number of block divisions DIVup1 is completed by the LD luminance calculating unit 1107 (st606). The LD block variable control unit 1109 judges whether or not the calculation of the LD luminance LDup1 by the LD luminance calculating unit 1107 is completed, on the basis of whether or not the LD luminance calculation completion notification from the LD luminance calculating unit 1107 is received.

If it is judged in st606 that the calculation of the LD luminance LDup1 is not completed, the LD luminance information holding unit 1108 applies the LD luminance LD(i) having been applied to the frame F(i), with respect to the frame (i+2). In this situation, the latest LD luminance, which is held by the LD luminance information holding unit 1108, is the LD luminance LD(i). The information of the LD luminance LD(i), which is the holding latest LD luminance information, is outputted by the LD luminance information holding unit 1108 to the backlight control unit 1111 and the luminance correcting unit 1102. The luminance correcting unit 1102 corrects the luminance with respect to the image data of the frame F(i+2) read from the buffer unit 1101 on the basis of the information of the LD luminance LD(i). The backlight control unit 1111 controls the light emission of each of the light source blocks of the backlight 1112 in accordance with the LD luminance LD(i). Thus, the display of the frame F(i+2) is performed in a state in which the backlight 1112 is subjected to the LD control with the LD luminance LD(i) (st611). After that, the routine returns to the process for detecting the input of the next frame (st604).

In the example shown in FIG. 4, the calculation of the LD luminance LDup1 is not completed at the timing T(i+4) (timing delayed by two frames from the input of the frame F(i+2)) at which the frame F(i+2) is displayed. Therefore, the negative judgment is made in st606. The LD luminance LD(i) is applied to the display of F(i+2) in accordance with the process in st611 (A7 in FIG. 4).

On the other hand, if it is judged in st606 that the calculation of the LD luminance LDup1 is completed, then the LD luminance information holding unit 1108 updates the information of the latest LD luminance by using the LD luminance LDup1 for which the calculation has been completed, and the LD luminance LDup1 is held as the latest LD luminance.

In the example shown in FIG. 4, it is judged that the frame F(i+3) is identical with the previous frame F(i+2) (st605: Yes). The calculation of the LD luminance LDup1 is completed at the timing T(i+5) at which the display of the frame F(i+3) is started (st606: Yes).

In this case, the LD luminance information holding unit 1108 applies the LD luminance LDup1 for which the calculation has been completed as described above, with respect to the frame F(i+3). That is, the information of the LD luminance LDup1 as the holding latest LD luminance is outputted by the LD luminance information holding unit 1108 to the backlight control unit 1111 and the luminance correcting unit 1102. In st607, the luminance correcting unit 1102 corrects the luminance of the image data of the frame F(i+3) on the basis of the information of the latest LD luminance LDup1 acquired from the LD luminance information holding unit 1108. Further, the backlight control unit 1111 controls the light emission of each of the light source blocks of the backlight 1112 in accordance with the information of the latest LD luminance LDup1 acquired from the LD luminance information holding unit 1108. Thus, the display of the frame F(i+3) is performed in a state in which the backlight 1112 is subjected to the LD control with the LD luminance LDup1 calculated with the number of block divisions DIVup1 which is increased by one level (st607, A8 in FIG. 4).

Further, the LD block variable control unit 1109 receives the LD luminance calculation completion notification from the LD luminance calculating unit 1107. The number of block divisions DIVup2, which is further increased by one level, is acquired from the number of block divisions table. The number of block divisions DIVup2 is held, which is outputted to the LD luminance calculating unit 1107. The LD luminance calculating unit 1107 starts the calculation of the LD luminance with the latest number of block divisions DIVup2 acquired from the LD block variable control unit 1109 (st608). After that, the routine returns to the process for detecting the input of the next frame (st604).

If the state, in which no change occurs in the frame, is continued, the processes of st606 to st611 are repeated. The number of block divisions is increased to DIVup1, DIVup2, and DIVup3, and the LD luminances LDup1, LDup2, and LDup3 are calculated with the finer numbers of block divisions while being finely divided. In other words, as shown in FIG. 7, the number of block divisions for the LD control becomes finer, when the input of the still image is continued. That is to say, the size of the light emission control block becomes smaller, when the input of the still image is continued. The finer the number of block divisions is (The smaller the size of the light emission control block), the more increased the time required until the completion of the calculation of the LD luminance is. However, the image data of the continuous frames is identical. Therefore, it is appropriate to perform the LD control by using the LD luminance having been already calculated and held, until the calculation is completed for the LD luminance in which the number of block divisions is made finer by one level. As the number of block divisions of the LD control is finer, it is possible to perform the display in which the uneven luminance is decreased. Therefore, according to the image display apparatus of this embodiment, it is possible to perform the high image quality display in which the audience hardly notices the uneven luminance even when the still image is displayed.

On the other hand, if any change arises in the frame, the LD luminance is calculated with the number of block divisions determined from the number of block divisions table corresponding to the number of pixels of the screen image and the frame cycle for each of the frames in accordance with bl500 shown in FIG. 6 (process to be performed if the image is the moving image as shown in FIG. 5). As described above, this process is controlled so that the calculation of the LD luminance is completed within two frames from the input of the frame. Therefore, it is possible to suppress the delay ranging from the input to the display even if the LD control is performed when the moving image is displayed.

The delay time from the input to the display is not limited to two frames. It is also appropriate that the user can set the delay time. The length of the delay time may be changeable, for example, between the game in which the quicker response performance is required and the moving image other than those in the game. If the delay time has any length other than two frames, it is also allowable that the timing, at which the number of uncalculated LD blocks is judged in st504 shown in FIG. 5, is not provided after the elapse of one frame after the start of the calculation. For example, if the delay time is three frames, it is also allowable that the number of uncalculated LD blocks is judged after the elapse of two frames from the start of the calculation, and the process is performed, for example, such that the uncalculated LD blocks are decreased so that the calculation of the LD luminance can be completed within one remaining frame.

In this embodiment, the number of block divisions is determined depending on whether the image is either the still image or the moving image (whether or not the image data of the present frame and the image data of the previous frame, which are temporally adjacent to one another, are identical with each other). However, there is no limitation thereto. For example, in the case of a moving image in which only a building is photographed as a photographic subject (object), the amount of motion is extremely small between two pieces of temporally adjoining frame image data (between frames). Therefore, the control may be performed such that the number of block divisions is increased for the moving image (hereinafter referred to as "moving image having small motion") in which the amount of motion is extremely small between pieces of frame image data (between frames) as described above, in the same manner as in the still image.

Specifically, as described above, the pixel values are compared with each other in units of pixels between two pieces of temporally adjoining frame image data (between frames) by means of the frame comparing unit 1106. If the number of pixels in which the pixel values are changed in the entire frame image data (amount of motion of the image) is not more than the predetermined threshold value A, the image, which is based on the image data inputted from the video output apparatus 12, is judged to be the still image. If the number of pixels is not more than the threshold value B (threshold value B> threshold value A) and larger than the threshold value A, it is judged that the image, which is based on the image data inputted from the video output apparatus 12, is the moving image having small motion. If the number of pixels is larger than the predetermined threshold value B, it is judged that the image, which is based on the image data inputted from the video output apparatus 12, is the moving image having large motion.

Further, the process (process for increasing the number of block divisions), in which the number of block divisions is increased in the stepwise manner as the time elapses, is also performed for the moving image having small motion as described above on the basis of this judgment. Accordingly, it is possible to suppress the occurrence of the uneven luminance, and it is possible to improve the image quality of the displayed image, in relation to the moving image having small motion as well. It is also allowable that only B is set as the threshold value to be used in this judgment to perform the following process. That is, if the amount of motion of the image is not more than the threshold value B, then it is judged that the image is the still image or the moving image having small motion, and the number of block divisions is increased on the basis of this judgment.

In this embodiment, the judgment to judge whether the image is either the moving image or the still image and the judgment to judge whether the image is either the moving image having large motion or the moving image having small motion may be performed on the basis of the motion vector. Specifically, the sum total of the magnitudes of the motion vectors of the entire image (amount of motion of the image) is calculated in relation to two pieces of temporally adjoining frame image data (between frames) in the frame comparing unit 1106. If the sum total of the magnitudes of the motion vectors is not more than a predetermined threshold value, it is judged that the image, which is based on the image data inputted from the video output apparatus 12, is the still image or the moving image having small motion. If the sum total of the magnitudes of the motion vectors is larger than the predetermined threshold value, it is judged that the image, which is based on the image data inputted from the video output apparatus 12, is the moving image having large motion.

As described above, in this embodiment, the LD block variable control unit 1109 performs the switching into the optimum light emission control blocks depending on the type of the displayed image. In other words, the LD block variable control unit 1109 sets the optimum size of the light emission control block in accordance with the amount of motion of the displayed image. As a result, it is possible to suppress the uneven luminance of the displayed image, and it is possible to improve the display image quality.

Second Embodiment

In the first embodiment, the example has been explained, in which the number of pixels of the video signal, the frame cycle, and the contents of the image data are investigated, and the number of block divisions in the LD control is determined depending on the obtained result. In a second embodiment, an example will be explained, in which the LD luminance information is included in the additional information of the inputted video signal. The following explanation will be made principally about the difference from the first embodiment.

Figure 8:
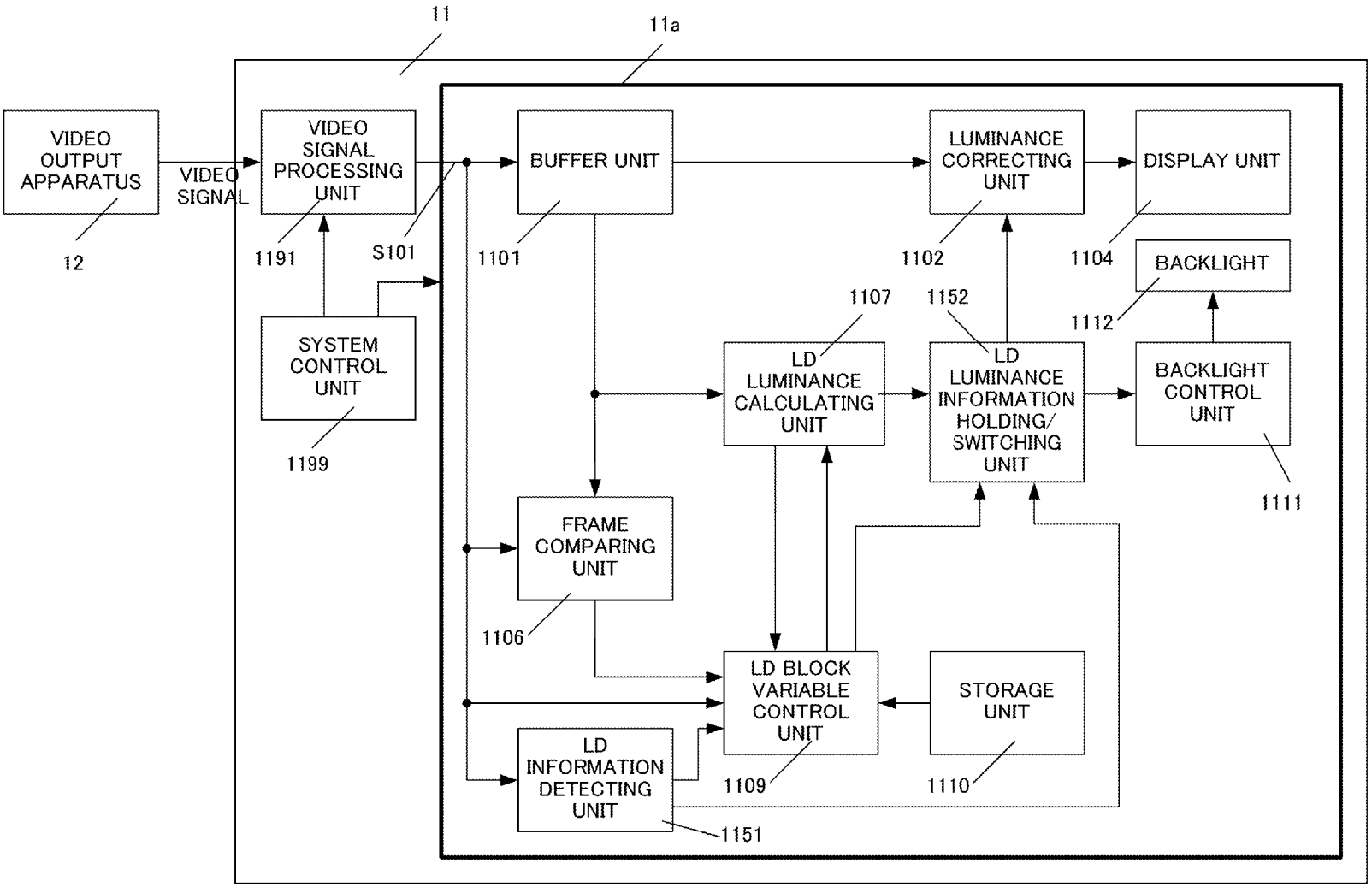
FIG. 8 shows a block diagram in relation to a second embodiment.

FIG. 8 shows functional blocks of an image display apparatus according to the second embodiment. The difference from the image display apparatus according to the first embodiment shown in FIG. 1 resides in that the LD luminance information holding unit 1108 of the first embodiment is replaced with an LD luminance information holding/switching unit 1152 in the second embodiment and that an LD information detecting unit 1151 is added in the second embodiment. The LD information detecting unit 1151 monitors whether or not the LD luminance information is included in the video signal. If it is detected that the LD luminance information is added to the video signal, the LD block variable control unit 1109 is notified of this fact. Further, the LD information detecting unit 1151 outputs the LD luminance information added to the video signal to the LD luminance information holding/switching unit 1152.

The LD luminance information holding/switching unit 1152 has the function in which the LD luminance information is inputted from the LD information detecting unit 1151 and the LD luminance information is held, in addition to the function of the LD luminance information holding unit 1108 as explained in the first embodiment. The LD luminance information, which is to be outputted to the luminance correcting unit 1102 and the backlight control unit 1111, is switched into any one of the LD luminance information inputted from the LD luminance calculating unit 1107 and the LD luminance information inputted from the LD information detecting unit 1151, by the LD luminance information holding/switching unit 1152. The LD block variable control unit 1109 controls the switching of the LD luminance information to be outputted by the LD luminance information holding/switching unit 1152 as described above.

Figure 9:
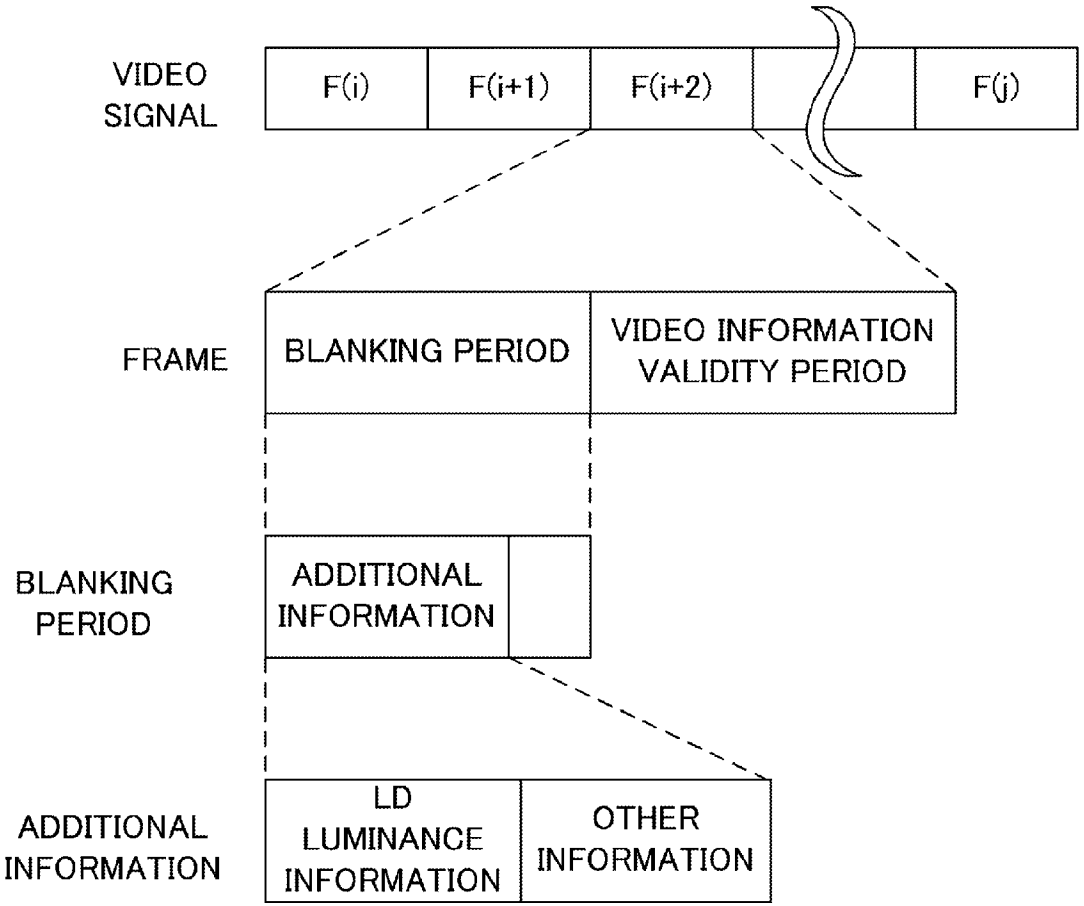
FIG. 9 illustrates a video signal used in the second embodiment.

FIG. 9 illustrates the data configuration of the video signal in this embodiment. With reference to FIG. 9, the video signal is composed of a plurality of continuous frames. Each of the frames is composed of a validity period of video information which includes the video information and a blanking period which includes no video information. The video information is composed of, for example, the video data and the synchronization signal information. The blanking period is composed of the additional information and a portion in which no data is present. The additional information is composed of the LD luminance information which is applied when the image data of this frame is displayed, and other information.

Figure 10:
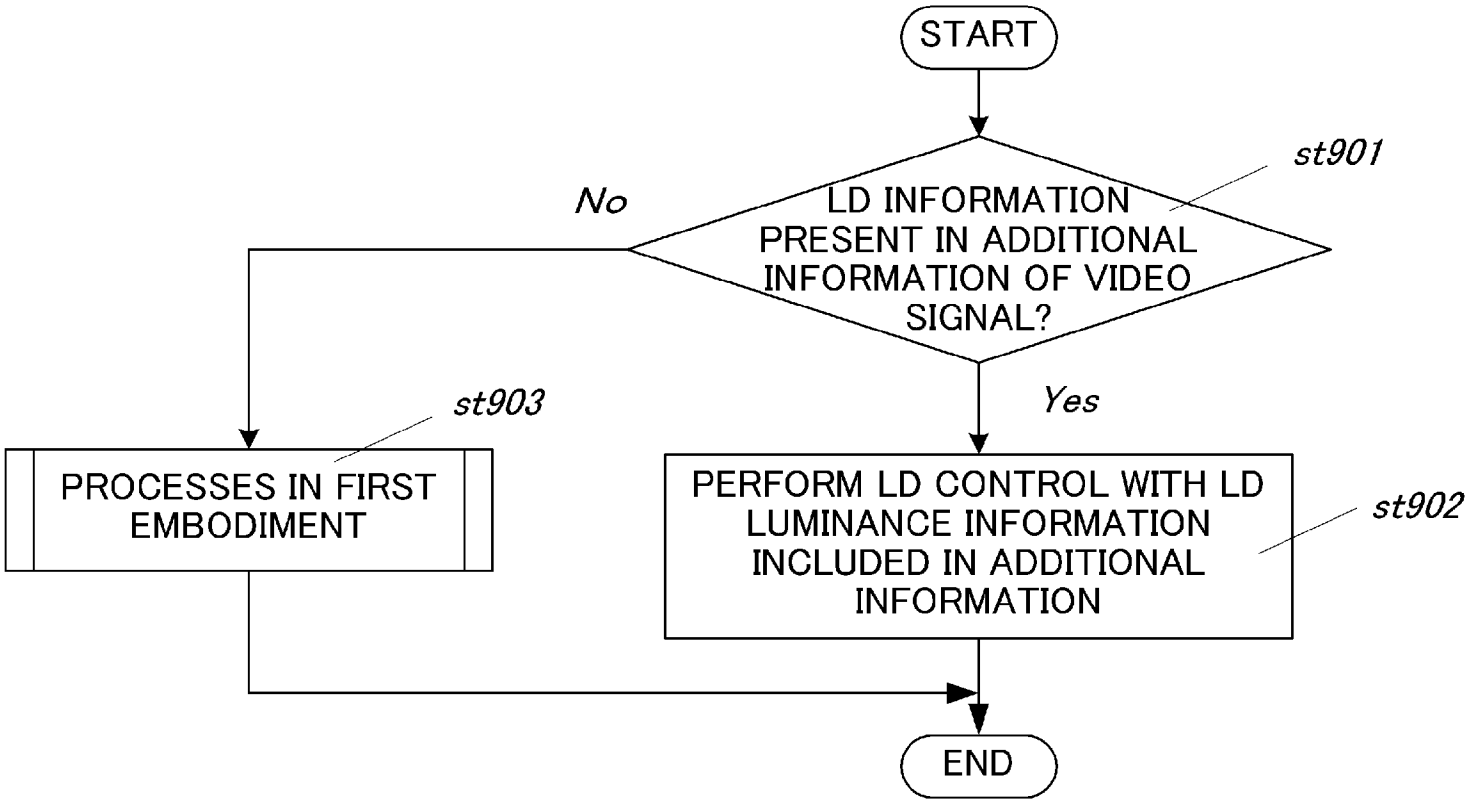
FIG. 10 illustrates the flow of the operation in the second embodiment.

FIG. 10 illustrates the flow of the operation of the image display apparatus in the second embodiment.

It is assumed that the LD control explained in the first embodiment is performed if the LD luminance information is not added to the video signal. In the second embodiment, it is monitored by the LD information detecting unit 1151 whether or not the additional information is present in the video signal. Further, it is monitored whether or not the LD luminance information is present in the additional information, if the additional information is present (st901).

If the LD information detecting unit 1151 detects the LD luminance information added to the video signal, then the detection result is outputted to the LD block variable control unit 1109, and the LD luminance information acquired from the video signal is outputted to the LD luminance information holding/switching unit 1152.

The LD block variable control unit 1109, which receives, from the LD information detecting unit 1151, the detection result to notify that the LD luminance information is added to the video signal, performs the following control with respect to the LD luminance information holding/switching unit 1152. That is, the LD block variable control unit 1109 performs the control with respect to the LD luminance information holding/switching unit 1152 so that the LD luminance information, which is to be outputted to the backlight control unit 1111 and the luminance correcting unit 1102, is switched into the LD luminance information inputted from the LD information detecting unit 1151.

The LD luminance information, which is received from the LD information detecting unit 1151, is outputted to the backlight control unit 1111 by the LD luminance information holding/switching unit 1152. The backlight control unit 1111 controls the light emission of each of the light source blocks of the backlight 1112 on the basis of the LD luminance information inputted from the LD luminance information holding/switching unit 1152. Further, the LD luminance information, which is received from the LD information detecting unit 1151, is outputted to the luminance correcting unit 1102 by the LD luminance information holding/switching unit 1152. The luminance correcting unit 1102 performs the luminance correction for the frame image data on the basis of the LD luminance information inputted from the LD luminance information holding/switching unit 1152. According to the process as described above, the LD control is performed on the basis of the LD luminance information which is acquired from the video signal by the LD information detecting unit 1151 (st902).

If the additional information is not detected in the video signal, or if the LD luminance information is not detected in the additional information although the additional information is detected, then the LD control explained in the first embodiment is carried out (st903).

In this embodiment, for example, if the LD luminance information, which is most appropriate for the concerning still image as previously calculated in accordance with the fine area divisions, is added to the video signal of the still image, the display, in which the most appropriate LD luminance information is applied, can be instantaneously performed without waiting for the completion of the calculation of the LD luminance to be performed by the LD luminance calculating unit 1107. Even in the case of the moving image without being limited to the still image, it is possible to further decrease the delay in the image display in which the LD control is performed, by performing the LD control by utilizing the previously calculated LD luminance information added to the video signal. If the LD luminance information, which is to be added to the video signal in the video output apparatus, can be adjusted by a user, it is also possible to perform the LD control by applying the LD luminance adjusted in response to the favorite of the user.

Third Embodiment

In the second embodiment, the example has been explained, in which the LD luminance information is added to the video signal. In a third embodiment, an example will be explained, in which the LD luminance information is inputted via an interface which is distinct from the input line for the video signal. The following explanation will be made principally about the difference from the first and second embodiments.

Figure 11:
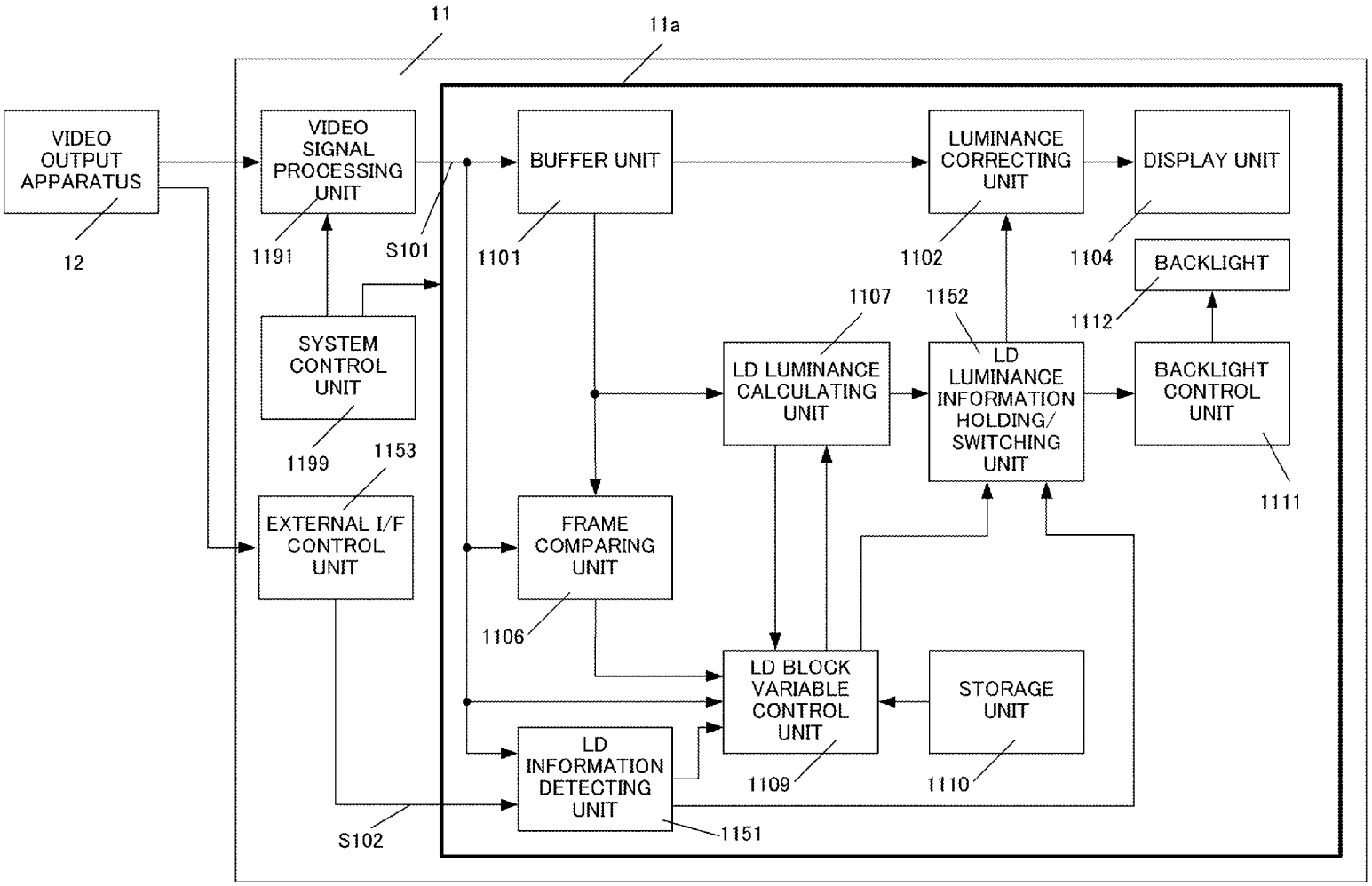
FIG. 11 shows a block diagram in relation to a third embodiment.

FIG. 11 shows functional blocks of an image display apparatus according to the third embodiment. The difference between the image display apparatus of this embodiment and the image display apparatus according to the second embodiment shown in FIG. 8 resides in that an external I/F control unit 1153 is added and that the LD information detecting unit 1151 has the function to detect the LD luminance information inputted from the external I/F control unit 1153.

Figure 13:
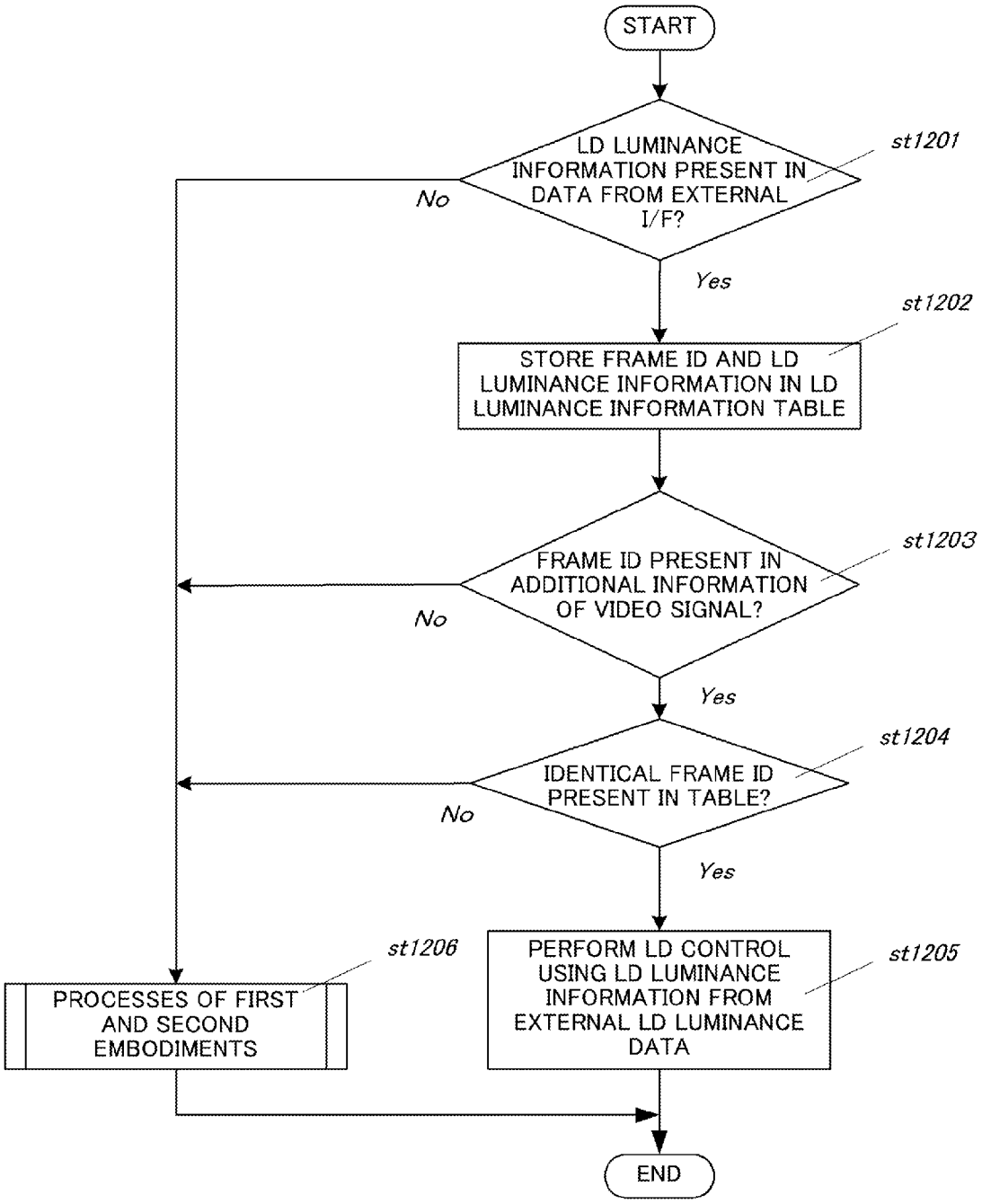
FIG. 13 illustrates the flow of the operation in the third embodiment.

The LD information detecting unit 1151 monitors whether or not the LD luminance information and the frame ID information explained with reference to FIG. 13 as described later on are included in the external LD luminance data S102 inputted from the external I/F control unit 1153. If the LD information detecting unit 1151 detects that the frame ID information and the LD luminance information are included in the external LD luminance data, they are stored as the LD luminance information table. Further, the LD luminance information, which is acquired from the external LD luminance data, is outputted to the LD luminance information holding/switching unit 1152 by the LD information detecting unit 1151.

Concurrently therewith, the LD information detecting unit 1151 monitors the presence or absence of the additional information of the video signal as explained with reference to FIG. 12 described later on, and the LD information detecting unit 1151 monitors whether or not the frame ID information is included in the additional information. If it is detected that the frame ID information is included in the additional information of the video signal, the LD information detecting unit 1151 judges whether or not the frame ID, which is identical with the frame ID added to the video signal, is present in the frame IDs stored in the LD luminance information table. The judgment result is outputted as the identical frame ID detection information to the LD block variable control unit 1109 by the LD information detecting unit 1151.

If it is judged that the frame ID, which is identical with the frame ID added to the video signal, is stored in the LD luminance information table, from the received identical frame ID detection information, the LD block variable control unit 1109 performs the following control with respect to the LD luminance information holding/switching unit 1152. That is, the LD block variable control unit 1109 performs the control with respect to the LD luminance information holding/switching unit 1152 so that the LD luminance information, which is to be outputted to the luminance correcting unit 1102 and the backlight control unit 1111, is switched into the LD luminance information inputted from the LD information detecting unit 1151.

The LD luminance information is inputted from the LD information detecting unit 1151 into the LD luminance information holding/switching unit 1152, and the LD luminance information is held. The LD luminance information is outputted to the backlight control unit 1111 and the luminance correcting unit 1102 in accordance with the switching control performed by the LD block variable control unit 1109.

An external interface, which is connected to the external I/F control unit 1153, is an input interface which is distinct from the input interface for the image data. The external interface performs the input of the external LD luminance data. The external interface is exemplified, for example, by an interface of the Ethernet (trade name) network. The external I/F control unit 1153 is connected to the video output apparatus 12, for example, by means of a cable. The external I/F control unit 1153 performs the data transmission/receiving and the control of the network communication including the video output apparatus 12 and the image display apparatus 11. If the data ID of the LD luminance information is detected in the received external LD luminance data as described later on, the external I/F control unit 1153 outputs the external LD luminance data to the LD information detecting unit 1151. The external interface is not limited to the Ethernet (trade name). It is also allowable to use USB and IEEE 1394 as well as a mobile phone irrelevant to the distinction in relation to the wireless or the wired.

Figure 12A:
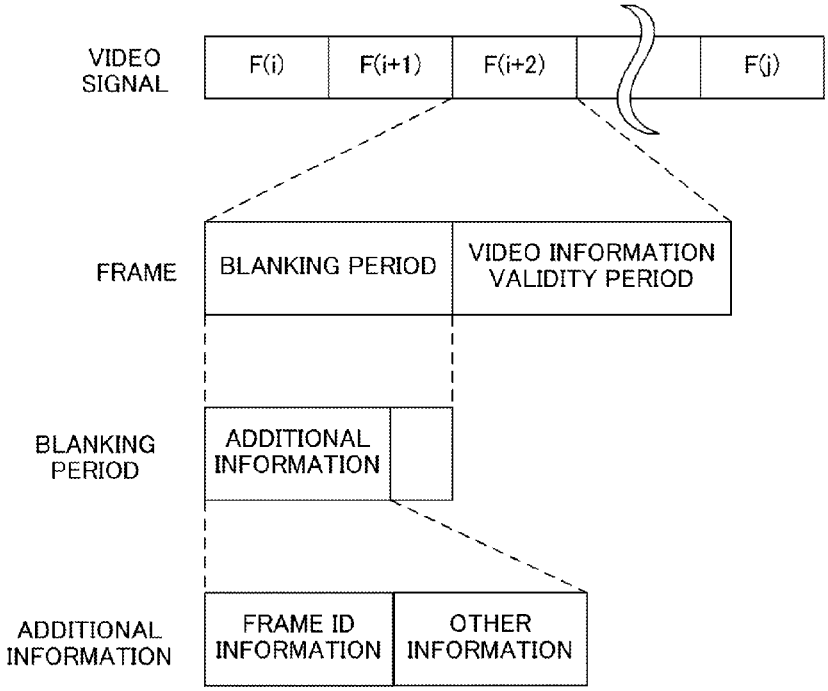
FIGS. 12A and 12B illustrates a video signal used in the third embodiment.

FIG. 12A illustrates the data configuration of the video signal in the third embodiment. The feature, which is different from the feature of the data configuration of the video signal explained in the second embodiment (FIG. 9), resides in that the frame ID information is included in the additional information of the frame with which the LD control is carried out. In this embodiment, the LD control is carried out by acquiring, from the LD luminance information table, the LD luminance information corresponding to the frame ID included in the additional information of the video signal by the LD luminance information holding/switching unit 1152.

Figure 12B:
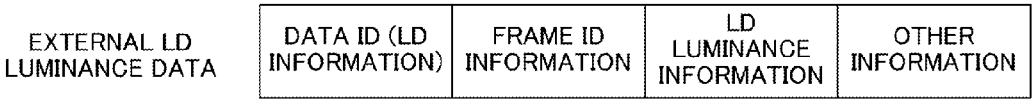

FIG. 12B illustrates the data configuration of the external LD luminance data. In FIG. 12B, the data ID is the identification information to indicate that the external LD luminance data is the data which relates to the LD luminance information. The frame ID is the identification information of the frame to which the LD luminance information included in the external LD luminance data is applied. The LD luminance information and other information are described continuously to the identification information.

An explanation will be made with reference to FIG. 13 about the flow of the operation of the image display apparatus according to the third embodiment. The explanation will now be made about the operation of the portions which relate to the processing of the LD luminance information.

The LD information detecting unit 1151 monitors whether or not the LD luminance information and the frame ID information are included in the external LD luminance data inputted from the external I/F control unit 1153 (st1201). If the LD luminance information and the frame ID information are included in the external LD luminance data, the LD information detecting unit 1151 stores the concerning frame ID and the LD luminance in the LD luminance information table while allowing the concerning frame ID and the LD luminance to be in correlation with each other (st1202).

On the other hand, the LD information detecting unit 1151 monitors whether or not the additional information is present in the video signal and whether or not the frame ID information is present in the additional information (st1203).

If it is detected that the frame ID information is included in the additional information of the video signal, the LD information detecting unit 1151 performs the retrieval for whether or not the frame ID, which is identical with the concerning detected frame ID, is present in the LD luminance information table (st1204).

If the frame ID, which is identical with the frame ID acquired from the additional information of the video signal, is present in the LD luminance information table, the LD information detecting unit 1151 outputs the identical frame ID detection information to the LD block variable control unit 1109. Further, the LD luminance information, which is allowed to correlate with the frame ID identical with the frame ID acquired from the additional information of the video signal, is acquired from the LD luminance information table by the LD information detecting unit 1151, and the LD luminance information is outputted to the LD luminance information holding/switching unit 1152. The LD luminance information is outputted to the backlight control unit 1111 and the luminance correcting unit 1102 by the LD luminance information holding/switching unit 1152.

The backlight control unit 1111 controls the light emission of each of the light source blocks of the backlight 1112 in accordance with the LD luminance information acquired from the LD luminance information holding/switching unit 1152. The luminance correcting unit 1102 performs the luminance correction for the frame image data on the basis of the LD luminance information inputted from the LD luminance information holding/switching unit 1152. According to the process as described above, the LD control is performed on the basis of the LD luminance information acquired from the external LD luminance data by the LD information detecting unit 1151 (st1205).

The operation is performed in the same manner as explained in the first embodiment and the second embodiment described above in relation to the following cases (st1206). That is, the cases are the case in which the LD luminance information is not included in the external LD luminance data in st1201, the case in which the frame ID information is not added to the video signal in st1203, and the casein which the frame ID, which is identical with the frame ID added to the video signal, is not present in the LD luminance information table in st1203.

In this embodiment, the LD luminance information is inputted by using the line different from the line for the video signal. Therefore, a plurality of different types of the LD luminance information can be inputted for the identical frame, and/or the LD luminance information can be inputted beforehand prior to the video signal so that the switching can be performed with the LD luminance information calculated from the video signal. Further, it is also possible to transmit a plurality of types of the LD luminance information corresponding to the LD control to be performed by different LD control devices or apparatuses.

Fourth Embodiment

Figures 16A, 16B, 16C:
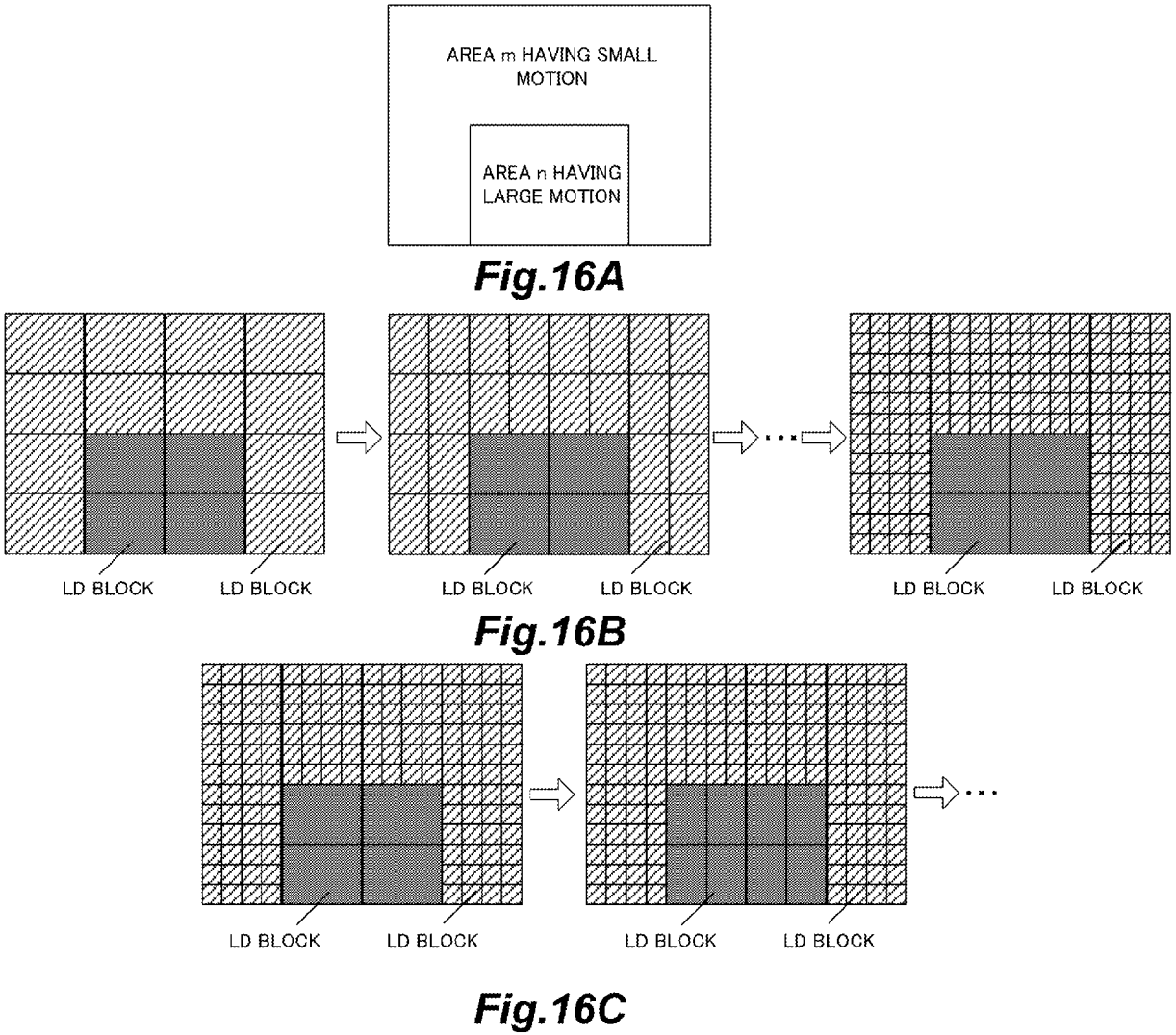
FIGS. 16A, 16B, and 16C illustrate the division control for LD blocks in the fourth embodiment.

In the first embodiment, the example has been explained, in which it is judged whether the image is either the moving image or the still image in relation to one displayed image, or it is judged whether the image is either the moving image having large motion or the moving image or the still image having small motion in relation to one displayed image so that the number of block divisions (the size of light emission control block) is determined in accordance with the obtained judgment result in the LD control. In a fourth embodiment, an example will be explained, in which the number of block divisions (the size of light emission control block) in the LD control is determined with respect to a moving image including both of a photographic subject (object) having small motion and a photographic subject (object) having large motion as compared with the foregoing photographic subject (object). Specifically, the fourth embodiment resides in such an example that the moving image, which is based on the moving image data inputted from the video output apparatus 12, is the moving image as shown in FIG. 16A as described later on. In this embodiment, it is assumed that the frame image data, which is inputted from the video output apparatus 12, is designated as F(i) in the same manner as in the first embodiment. It is assumed that the number of block divisions, with which the calculation of the LD luminance information can be completed within the delay time when the frame F(i) is inputted, is designated as DIV(i). It is assumed that the LD luminance, which is applied to the frame F(i), is designated as LD(i). The functions, which are the same as the functions provided in the first embodiment, are designated by the same reference numerals, and the explanation of the concerning functions is omitted.

Figure 14:
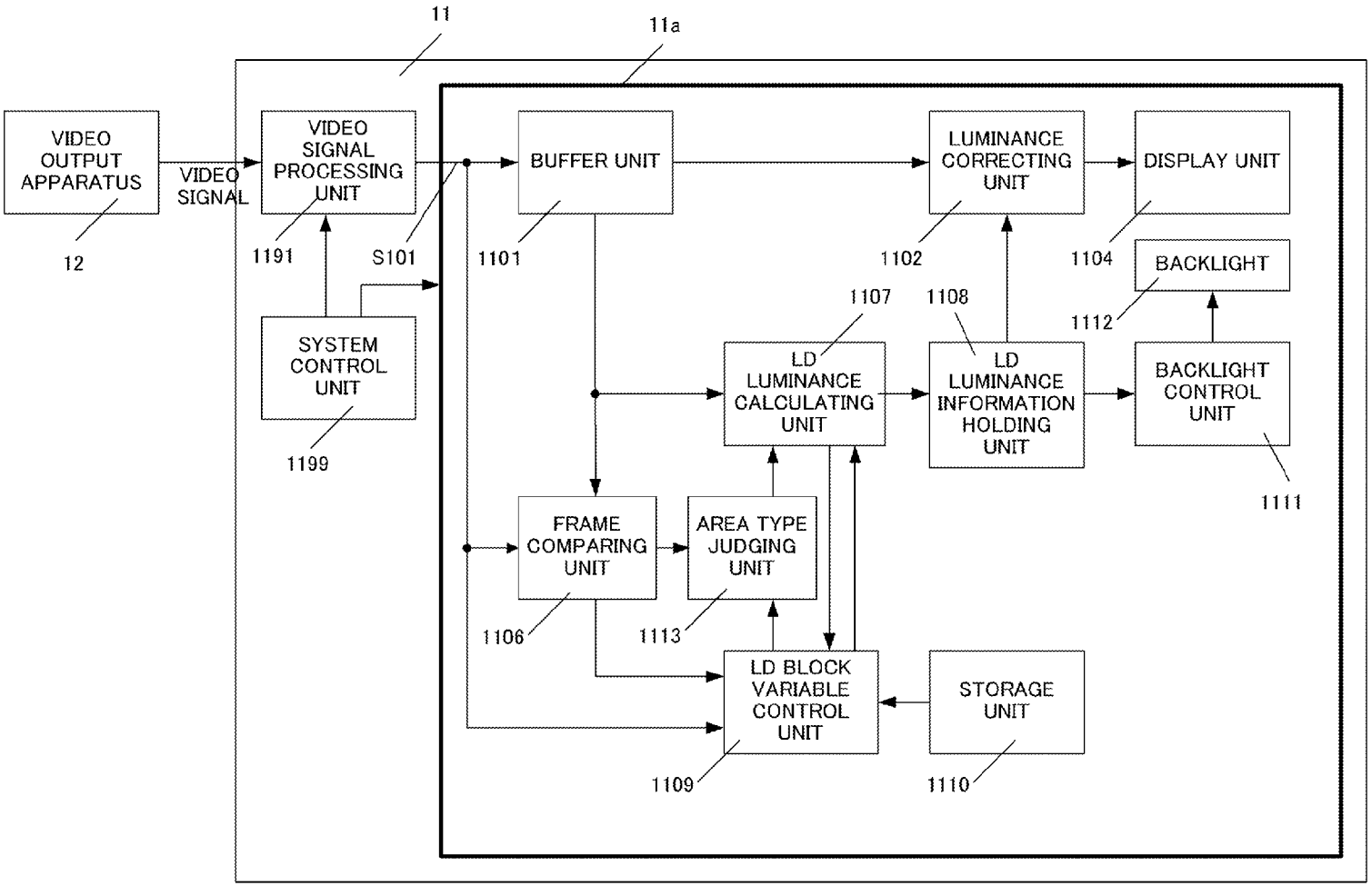
FIG. 14 shows a block diagram in relation to a fourth embodiment.
Figure 15:
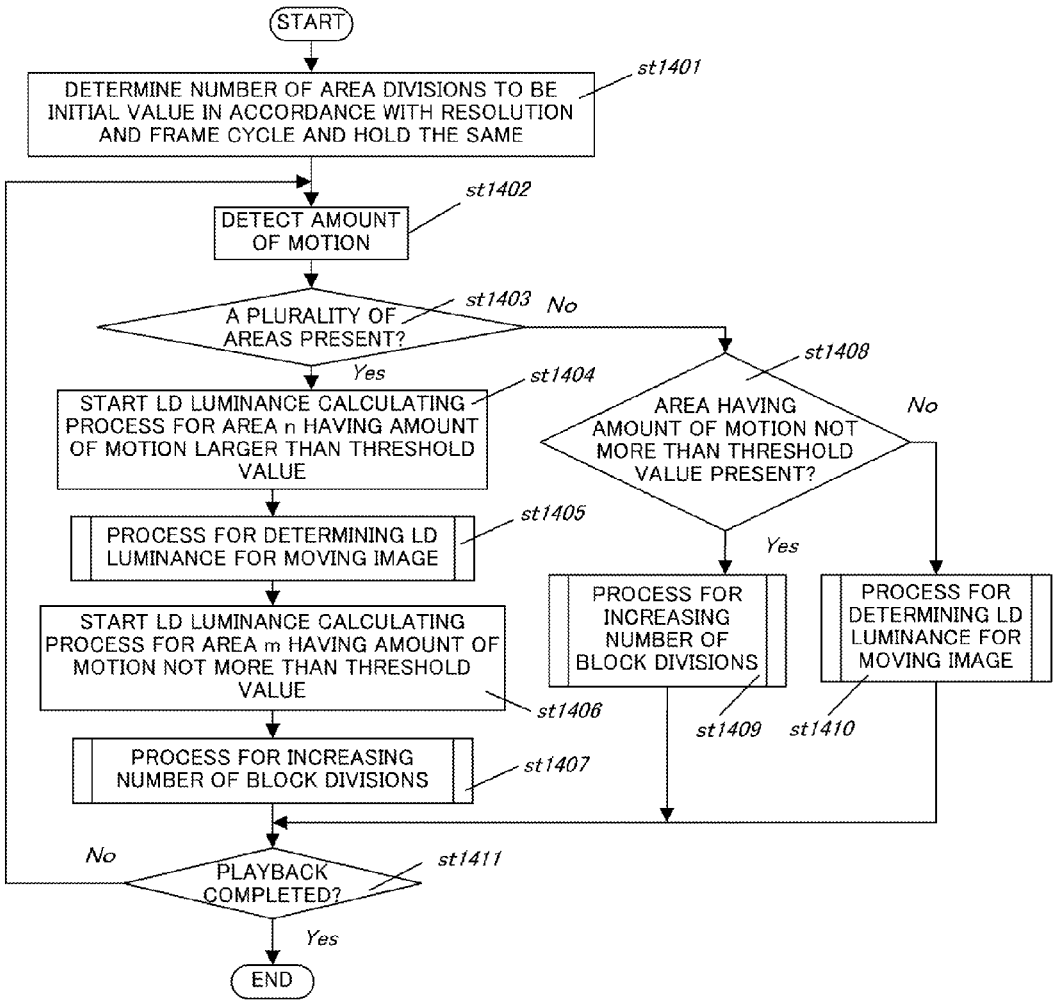
FIG. 15 illustrates the flow of the operation in the fourth embodiment.
Figure 17A:
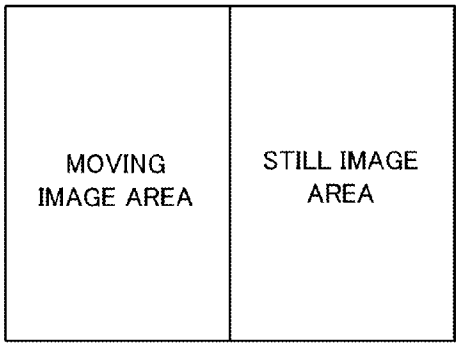
FIGS. 17A and 17B illustrate the division control for LD blocks in the fourth embodiment.
Figure 17B:
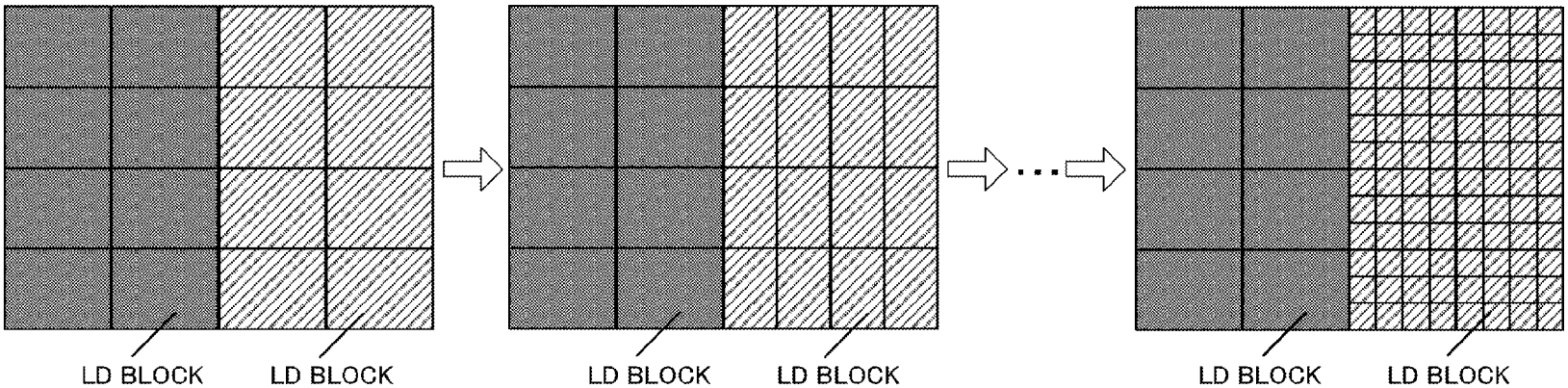
Figure 18A:
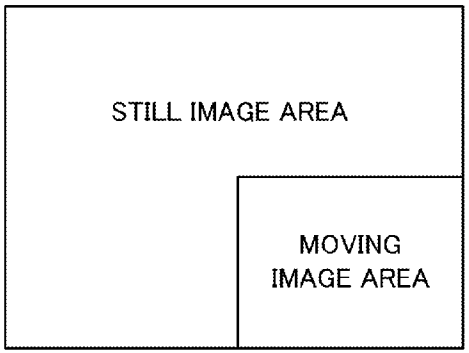
FIGS. 18A and 18B illustrate the division control for LD blocks in the fourth embodiment.
Figure 18B:
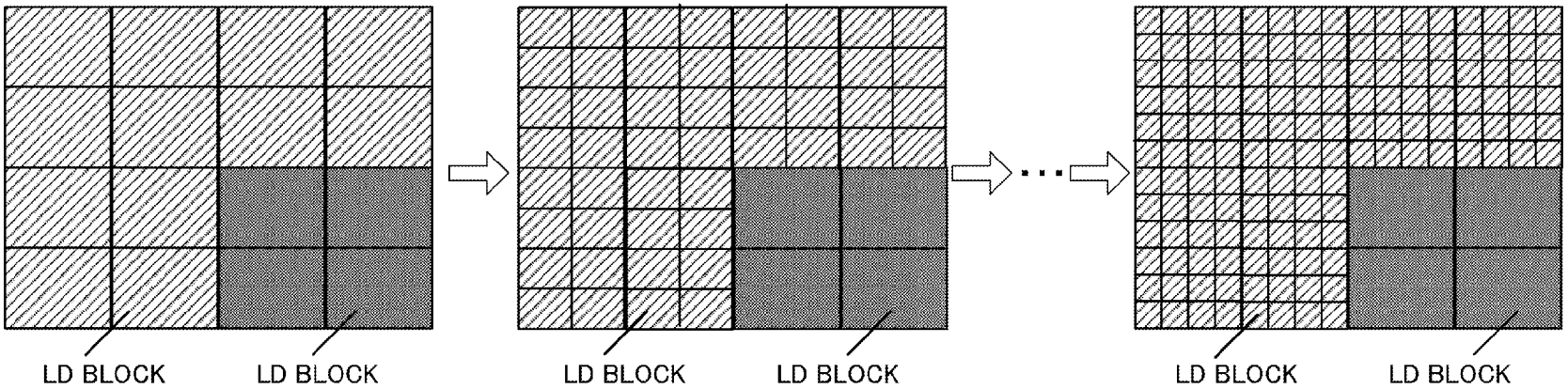

FIG. 14 shows functional blocks of an image display apparatus according to the fourth embodiment. The difference between the image display apparatus of this embodiment and the image display apparatus according to the first embodiment resides in that an area type determining unit 1113 (area determining unit) is added. FIG. 15 illustrates the flow of the operation in the fourth embodiment. FIGS. 16A, 17A, and 18A show examples of displayed images in the fourth embodiment. FIGS. 16B, 17B, and 18B illustrate the division control for LD blocks with respect to the exemplary displayed images in the fourth embodiment. The operation of the image display apparatus of this embodiment will be explained with reference to FIGS. 14 to 18.

At first, the number of block divisions DIV (i), which is to be applied to the frame F(i), is determined (st1401) in the same manner as in the first embodiment. Subsequently, the amount of motion of the image is detected to perform an area determining process for the image (st1402).

The great difference between the first embodiment and the fourth embodiment resides in the area determining process for the image in st1402. The image determining process in the first embodiment is executed on the basis of the amount of motion of the pixels in the entire frame image data. However, the image determining process in this embodiment is executed on the basis of the amount of motion of the pixels in relation to each of divided areas of the frame image data.

Specifically, if the frame image data is inputted from the video output apparatus 12, the LD block variable control unit 1109 retrieves the number of block divisions DIV(i) with which the LD luminance can be calculated within a period of time shorter than a predetermined delay time, by making reference to a number of block divisions table. The LD block variable control unit 1109 acquires the information of the concerning number of block divisions. In this embodiment, the predetermined delay time is two frames. The LD block variable control unit 1109 outputs the acquired information of the number of block divisions to the area type determining unit 1113. Further, the frame comparing unit 1106 compares the pixel values of the frame image data of the present frame with those of the previous frame in units of pixels. The information of pixel motion, which is the information to indicate whether or not the respective pixels have moved, is outputted to the area type determining unit 1113. The area type determining unit 1113 calculates the number of moved pixels in each of the divided areas corresponding to each of the LD blocks on the basis of the information of the number of block divisions and the information of pixel motion. It is judged that the divided area, in which the concerning number of pixels is not more than a predetermined threshold value, is an area m having small motion (first display area), and it is judged that the divided area, in which the concerning number of pixels is larger than the predetermined threshold value, is an area n having large motion (second display area) as compared with the area m (st1402). The area type determining unit 1113 outputs, to the LD luminance calculating unit 1107, the information to indicate whether or not the two types of areas of the area m and the area n are present in a mixed manner in the moving image based on the moving image data inputted from the video output apparatus 12. If the two types of areas, i.e., the area m and the area n are present in the mixed manner, the position information of each of the areas (area position information) is outputted to the LD luminance calculating unit 1107 (st1403). In this embodiment, for example, as shown in the left drawing in FIG. 16B, it is assumed that the number of block divisions of the area m is the number of divisions which is ¾ of the number of block divisions DIV(i) of the entire image, and the number of block divisions of the area n is the number of divisions which is ¼ of the number of block divisions DIV(i) of the entire image.

Once the number of block divisions is determined, the LD luminance calculating unit 1107 progressively performs the calculation of the LD luminance information LD(i) with the number of block divisions DIV(i) for each of the areas (areas m, n). Specifically, the image data of the frame F(i), which is read from the buffer unit 1101, is progressively analyzed by the LD luminance calculating unit 1107 in units of the divided areas in relation to each of the areas on the basis of the area position information. In this embodiment, if the areas m and n are present in the mixed manner while taking the judgment result provided in st1403 into account, the calculation is firstly performed for the LD luminance of the divided area corresponding to the area n (st1404). The LD luminance determining process is performed for the moving image as described later on (st1405). The LD luminance calculating unit 1107 is set so that the LD luminance is calculated for the divided area corresponding to the area m (st1406) after the completion of the calculating process for calculating the LD luminance for the moving image.

If the judgment of the area is completed by the area type determining unit 1113, and the calculation of the LD luminance for the area n is started, then it is judged for the area n whether or not the area n has the number of block divisions for which the calculation of the LD luminance is reliably completed within the delay time, in the same manner as in the first embodiment. If the area n has the number of block divisions for which the calculation of the LD luminance is not completed, the correction is performed. The process for determining the LD luminance for the moving image shown in FIG. 15 (st1405) is the process corresponding to the processes of st504 to st507, st511, and st512 shown in FIG. 5 in the first embodiment. Specifically, in this embodiment, the delay time is two frames, the areal size of the area m is the size of ¾ of the areal size of the entire image area, and the areal size of the area n is the size of ¼ of the areal size of the entire image area. Therefore, the periods of time, which can be consumed for the calculation of the LD luminance allotted to the areas m, n, are 0.5 frame (2 frames×¼) and 1.5 frames (2 frames×¾) respectively. In other words, in this embodiment, it is necessary that the area n should have the LD block divided areas for which the calculation of the LD luminance can be completed within 0.5 frame. The LD block variable control unit 1109 acquires the number of blocks for which the LD luminance calculation has been completed, from the LD luminance calculating unit 1107 at the point in time at which a predetermined period of time (0.25 frame in this procedure) has elapsed after the start of the calculation of the LD luminance LD(i), in the same manner as in the first embodiment so that the progress status of the calculation of the LD luminance LD(i) is confirmed. The LD block variable control unit 1109 determines the number of block divisions to be applied to the next frame and the followings (F(i+1) and the followings) on the basis of the concerning confirmation result, and the number of block divisions is applied thereto. According to this control, it is possible to suppress the delay ranging from the input to the display, even is the LD control is performed when the moving image is displayed.

On the other hand, if the number of uncalculated LD blocks is not less than ½ of the number of block divisions of the area n at the point in time at which 0.25 frame has elapsed after the start of the calculation of the LD luminance, the LD block variable control unit 1109 judges that it is impossible to calculate the LD luminance for the uncalculated LD blocks within remaining 0.25 frame in the case of the initial number of block divisions of the area n. In this case, the LD block variable control unit 1109 redivides the area of the backlight 1112 corresponding to the uncalculated LD blocks into the LD blocks of a number smaller than the number of uncalculated LD blocks. In other words, the LD block variable control unit 1109 increases the size of the uncalculated LD blocks. The LD luminance calculating unit 1107 calculates the luminance for newly provided LD blocks brought about by the redivision at and after the point in time at which one frame has elapsed. In this procedure, the LD block variable control unit 1109 retrieves the number of block divisions which is smaller by one level than the number of block divisions DIV(i) applied to the frame F(i) on the basis of the number of block divisions table. The LD block variable control unit 1109 holds, as the latest number of block divisions, the value obtained by multiplying the number of block divisions (DIVdn1) obtained by the retrieval by the ratio of the number of block divisions of the area n with respect to the number of block divisions of the entire image. In this embodiment, the number of block divisions of the area n is the number of divisions which is ¼ of the number of block divisions of the entire image. Therefore, the number of block divisions of DIVdn1×¼ is held by the LD block variable control unit 1109. If the value of DIVdn1×¼ is indivisible, the LD block variable control unit 1109 holds the number of block divisions obtained by omitting the figures below the decimal point. The LD luminance calculating unit 1107 acquires the concerning latest number of block divisions DIVdn1 from the LD block variable control unit 1109, and the concerning latest number of block divisions DIVdn1 is set as the number of block divisions to be applied to the next frame and the followings (F(i+1) and the followings). Accordingly, the number of block divisions is corrected so that the calculation of the LD luminance for the next frame F(i+1) and the followings is reliably completed within 0.5 frame.

Further, the LD block variable control unit 1109 changes the way of division of the area of the backlight 1112 corresponding to uncalculated LD blocks so that the calculating process for calculating the LD luminance to be applied to the frame F(i) can be completed within remaining 0.25 frame. In this procedure, the LD block variable control unit 1109 decreases the number of uncalculated LD blocks by collecting two uncalculated LD blocks adjoining in the lateral direction to provide one new uncalculated LD block. Uncalculated LD blocks, which cannot be collected as two blocks in the lateral direction, are left as they are, for example, when the number of uncalculated LD blocks is an odd number in the case of the initial number of block divisions DIV(i) or when the number of divisions in the lateral direction is an odd number. The method for changing the way of division of the area of the backlight 1112 corresponding to uncalculated LD blocks is not limited thereto. The LD block variable control unit 1109 outputs the information of the uncalculated LD blocks after the decrease to the LD luminance calculating unit 1107. The LD luminance calculating unit 1107 calculates the LD luminance on the basis of the image data of the frame F(i) for each of the uncalculated LD blocks after the decrease. According to the processes as described above, the control is performed such that the calculation of the LD luminance is completed within 0.5 frame after the input of the frame. Therefore, even when the LD control is performed during the display of the moving image, it is possible to suppress the delay ranging from the input to the display.

After the completion of the LD luminance determining process for the moving image (st1405), the calculation of the LD luminance is executed by the LD luminance calculating unit 1107 with respect to the area m (st1406). When this calculating process is completed, the LD luminance LD(i) is applied to the area m of the frame F(i) in the same manner as in the first embodiment. As shown in st1407 in FIG. 15 and FIG. 16B, the process for increasing the number of block divisions is performed to increase the number of block divisions in a stepwise manner in the same manner as in the first embodiment. In other words, the process is performed for decreasing the size of the light emission control block in relation to the area m in a stepwise manner. Specifically, in this embodiment, the LD block variable control unit 1109 acquires, from the number of block divisions table, the number of block divisions DIVup1 which is increased by one level as compared with the number of block divisions DIV(i) applied to the frame F(i). The value (DIVup1×¾ in this procedure), which is obtained by multiplying the number of block divisions DIVup1 by the ratio of the number of block divisions of the area m with respect to the number of block divisions of the entire image, is held as the latest number of block divisions. The concerning latest number of block divisions is progressively applied to the area m in the same manner as in the first embodiment. The number of block divisions of the area m is progressively increased in the stepwise manner by repeating this control. Accordingly, it is possible to suppress the uneven luminance in the moving image area having small motion, and it is possible to improve the image quality of the displayed image. As a result, according to the image display apparatus of this embodiment, even when the moving image is displayed, it is possible to set the optimum number for the number of divisions of the corresponding respective LD blocks in relation to each of the divided areas of each of the image areas. Therefore, it is possible to perform the high image quality display in which the audience hardly notices the uneven luminance.

As shown in FIG. 16B, the number of block divisions of the area m is increased in a stepwise manner, and the maximum number of block divisions, which is applicable to the area m, is applied to the area m in some cases. In such a situation, the maximum number of block divisions is continuously applied to the area m if the frame image data is not changed, after the application of the maximum number of block divisions. In this situation, it is unnecessary for the LD luminance calculating unit 1107 to execute the LD luminance calculating process with respect to the area m. Therefore, it is also allowable that the ability to perform the calculating process, which corresponds to the amount of the LD luminance calculating process for the area m for which the execution is not performed, is allotted to the LD luminance calculating process for the area n. In this case, as shown in FIG. 16C, the ability to perform the LD luminance calculating process for the area n is enhanced. It is possible to further increase the number of divisions of the area n, while maintaining the maximum number of block divisions of the area m. Therefore, it is possible to further suppress the uneven luminance in the moving image, and it is possible to perform the high quality display.

If it is judged in st1403 that the image, which is based on the image data inputted from the image output apparatus 12, is the image in which two types of areas are not present in a mixed manner, the following process is performed. That is, it is judged whether or not only the area, in which the amount of motion of pixels between the frames of the image obtained in st1402 is not more than a predetermined threshold value, is present, or whether or not only the area, in which the amount of motion is larger than the predetermined threshold value, is present (st1408). Depending on the concerning judgment result, the process for increasing the number of block divisions in a stepwise manner or the process for determining the LD luminance for the moving image is performed (st1409, st1410).

The processes as described above are repeated until the completion of playback is instructed in st1411.

In this embodiment, the amount of motion may be judged on the basis of the motion vector. Specifically, the sum total of the magnitudes of the motion vectors in units of divided areas in relation to each of the areas (areas m, n) (amount of motion of the image) is calculated between the frames of the image by means of the frame comparing unit 1106. The area, in which the sum total of the magnitudes of the motion vectors is not more than a predetermined threshold value, is judged to be the area m having small motion. On the other hand, the area, in which the sum total of the magnitudes of the motion vectors is larger than the predetermined threshold value, is judged to be the area n having large motion.

Only a part of the area m is changed to the area n in which the amount of motion of the image is larger than the threshold value, during the display of the moving image, and the areal size of the area m is reduced in some cases. In such a situation, it is also appropriate to perform the process for increasing the number of block divisions as described above for the reduced area m, while considering the ratio of the number of block divisions of the area m after the reduction with respect to the number of block divisions of the entire image. On the other hand, as for the enlarged area n, it is also appropriate to perform the control as described above for setting again the optimum number of block divisions with which the LD luminance calculation is completed for the enlarged area n within the elapse of a predetermined frame, while considering the amount of enlargement of the area n. On the contrary, if a part of the area n is reduced and a part of the area m is enlarged in an amount corresponding thereto, then it is also appropriate to perform the same or equivalent control.

The explanation has been made in this embodiment about the case (Yes in st1403) in which the two types of areas m, n are present. However, there is no limitation thereto. The control of this embodiment is also applicable to such a case that three or more types of a plurality of areas are present.

For example, as shown in FIG. 17A, it is assumed that the moving image data and the still image data are inputted from the video output apparatus 12. In this case, as described above, it is possible to judge the moving image area and the still image area according to the amount of motion of each of the divided areas. After that, the process for determining the LD luminance for the moving image in st1405 shown in FIG. 15 is executed for the moving image area. The process for increasing the number of block divisions in st1407 shown in FIG. 15 is executed as shown in FIG. 17B for the still image area. By doing so, even if a plurality of types of images are displayed, it is possible to set the optimum number for the number of divisions of the corresponding respective LD blocks in relation to each of the divided areas of each of the image areas. As a result, it is possible to perform the high image quality display for which the audience hardly notices the uneven luminance.

This embodiment is also applicable to the so-called P in P (Picture in Picture) display in which another image is superimposed and displayed on a part of the area of the image. For example, when a moving image is displayed on a partial area of a still image as shown in FIG. 18A, it is possible to judge the moving image area and the still image area according to the amount of motion of each of the divided areas as described above. After that, the process for determining the LD luminance for the moving image in st1405 shown in FIG. 15 is executed for the moving image area. The process for increasing the number of block divisions in st1407 shown in FIG. 15 is executed for the still image area as shown in FIG. 18B. Accordingly, even when a plurality of types of images are displayed, it is possible to set the optimum number for the number of divisions of the corresponding respective LD blocks in relation to each of the divided areas of each of the image areas. As a result, it is possible to perform the high image quality display in which the audience hardly notices the uneven luminance.

Also in the procedures as described above, if the number of block divisions of the still image area arrives at the maximum number of divisions, the processing ability to perform the LD luminance calculating process, which would be otherwise used for the still image area for which the execution is not performed, may be allotted to the process for calculating the LD luminance for the moving image area. In this case, the ability to perform the LD luminance calculating process for the moving image area is enhanced, and it is possible to further increase the number of block divisions of the moving image area, while maintaining the maximum number of block divisions of the still image area. Therefore, it is possible to further suppress the uneven luminance in the moving image, and it is possible to perform the high image quality display.

The process of this embodiment may be applied to the second embodiment. Specifically, it is also allowable to construct such a procedure that the process of this embodiment is executed in st903 shown in FIG. 10 in the second embodiment. Further, the process of this embodiment may be applied to the third embodiment. Specifically, it is also allowable to construct such a procedure that the process of this embodiment is executed in st1206 shown in FIG. 13 in the third embodiment.

This embodiment is illustrative of such a case that the moving image and the still image are displayed on one screen of the image display apparatus 11. However, even when a moving image having large motion and a moving image having small motion are displayed on one screen of the image display apparatus 11, it is possible to perform the same or equivalent process. Further, even when images of three or more types based on mutually different pieces of image data, in which a moving image having large motion is combined with at least one of a still image and a moving image having small motion, are displayed on one screen of the image display apparatus 11, it is possible to perform the same or equivalent process.

It is also allowable that the area type determining unit 1113 acquires the attached information (information to indicate the file type such as JPEG, MPEG or the like) of the image data outputted from the video output apparatus 12 to judge the type for each of the areas. In this case, the video output apparatus 12 and the image display apparatus 11 are connected to one another via an interface (for example, HDMI, Display Port or the like) with which the attached information of the image data can be transmitted/received.

This embodiment is illustrative of the exemplary case in which the process for increasing the number of divisions is executed in st1407 shown in FIG. 15. However, there is no limitation thereto. If the still image area is a moving image area having small motion in st1407 shown in FIG. 15, it is also allowable to perform the control such that the number of block divisions is decreased on the basis of the change of the amount of motion of the image.

As described above, in this embodiment, the LD block variable control unit 1109 switches to the optimum light emission control block in accordance with the amount of motion of the image in each display area of image. In other words, the LD block variable control unit 1109 sets the optimum size of the light emission control block in accordance with the amount of motion of the image in each display area of image. As a result, it is possible to suppress the uneven luminance of the displayed image, and it is possible to improve the display image quality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, the explanation has been made on condition that the division of the backlight 1112 by using the LD blocks is the equal division in relation to both of the lateral direction and the longitudinal direction (all of the LD blocks have the same size). However, it is also allowable that the division widths and/or the LD block sizes are not equivalent in one screen. The explanation has been made about the exemplary case of the number of block divisions table as prepared while considering the frame cycle and the number of pixels of the video data as the elements or factors which affect the period of time required to calculate the LD luminance. However, it is also allowable to use any number of block divisions table taking any other element or factor into consideration. For example, the data length of the video data may be considered as the element or factor relevant to the calculation of the LD luminance. Further, the number of block divisions table may be provided for each of video modes (for example, VESA, SMPTE (definition of frame cycle and number of pixels standardized or normalized by the standard organization) or the like). Further, in the present invention, the control is performed to change the number of block divisions on the basis of, for example, the type of the image. In this control, the number of light sources is changed within one LD block. That is, in the present invention, the control is performed such that the number of light sources in one LD block is changed on the basis of, for example, the type of the image, in other words.

This application claims the benefit of Japanese Patent Application No. 2011-192825, filed on Sep. 5, 2011, Japanese Patent Application No. 2012-181826, filed on Aug. 20, 2012, and Japanese Patent Application No. 2012-191713, filed on Aug. 31, 2012, which are hereby incorporated by reference herein in their entirety.

The invention claimed is:

1. An image display apparatus for displaying an image on the basis of image data, the image display apparatus comprising:

light emitting unit which has a plurality of light sources for performing light emission that can be independently controlled respectively;

setting unit which sets light emission control blocks for controlling one light source or the plurality of light sources with a common light emission brightness;

brightness determining unit which determines the light emission brightness of each of the light emission control blocks on the basis of the image data; and control unit which controls the light emission of the light emitting unit for each of the light emission control blocks in accordance with the light emission brightness determined by the brightness determining unit, wherein:

the setting unit sets a size of the light emission control block of the light emitting unit depending on an amount of motion of the image, and the setting unit sets the size of the light emission control block so that the brightness determining unit can determine the light emission brightness of the light source of each of all of the light emission control blocks within a predetermined period of time.

2. The image display apparatus according to claim 1, wherein the size of the light emission control block of the light emitting unit is decreased for the image in which a value of the amount of motion is not more than a predetermined threshold value, as compared with the image in which the value of the amount of motion is larger than the predetermined threshold value.

3. The image display apparatus according to claim 1, wherein the image includes a plurality of display areas, and the setting unit sets the size of the light emission control block of the light emitting unit corresponding to each of the display areas depending on the amount of motion of the image in each of the display areas of the image.

4. The image display apparatus according to claim 3, wherein the plurality of display areas include a first display area and a second display area, and the setting unit decreases the size of the light emission control block of the light emitting unit corresponding to the first display area as compared with the size of the light emission control block of the light emitting unit corresponding to the second display area, if a value of the amount of motion of the first display area is not more than a predetermined threshold value and a value of the amount of motion of the second display area is larger than the predetermined threshold value.

5. The image display apparatus according to claim 4, wherein the setting unit decreases the size of the light emission control block of the light emitting unit corresponding to the first display area in a stepwise manner as time elapses.

6. The image display apparatus according to claim 4, wherein the size of the light emission control block corresponding to the first display area is set to a predetermined size by the setting unit, the setting unit thereafter maintains the predetermined size of the light emission control block corresponding to the first display area as time elapses, and the setting unit decreases the size of the light emission control block corresponding to the second display area as time elapses.

7. The image display apparatus according to claim 3, further comprising area determining unit which determines whether or not the plurality of display areas, among which the amount of motion of the image mutually differs, are present in the image to be displayed on the image display apparatus, on the basis of attached information of the image data.

8. The image display apparatus according to claim 1, wherein the amount of motion of the image is a number of pixels in which pixel values of the image data are changed between two temporally adjoining frames of the image, or a sum total of magnitudes of motion vectors of the image data in relation to the two temporally adjoining frames.

9. A control method for controlling an image display apparatus comprising light emitting unit which has a plurality of light sources for performing light emission that can be independently controlled respectively, for displaying an image on the basis of image data, the control method comprising:

a setting step of setting light emission control blocks for controlling one light source or the plurality of light sources with a common light emission brightness;

a brightness determining step of determining the light emission brightness of each of the light emission control blocks on the basis of the image data; and a control step of controlling the light emission of the light emitting unit for each of the light emission control blocks in accordance with the light emission brightness determined by the brightness determining step, wherein:

a size of the light emission control block of the light emitting unit is set depending on an amount of motion of the image in the setting step, and the size of the light emission control block is set in the setting step so that the light emission brightness of the light source can be determined for each of all of the light emission control blocks within a predetermined period of time in the brightness determining step.

10. The control method for controlling the image display apparatus according to claim 9, wherein the size of the light emission control block of the light emitting unit is decreased for the image in which a value of the amount of motion is not more than a predetermined threshold value, as compared with the image in which the value of the amount of motion is larger than the predetermined threshold value.

11. The control method for controlling the image display apparatus according to claim 9, wherein the image includes a plurality of display areas, and the size of the light emission control block of the light emitting unit corresponding to each of the display areas is set depending on the amount of motion of the image in each of the display areas of the image in the setting step.

12. The control method for controlling the image display apparatus according to claim 11, wherein the plurality of display areas include a first display area and a second display area, and the size of the light emission control block of the light emitting unit corresponding to the first display area is decreased as compared with the size of the light emission control block of the light emitting unit corresponding to the second display area, if a value of the amount of motion of the first display area is not more than a predetermined threshold value and a value of the amount of motion of the second display area is larger than the predetermined threshold value, in the setting step.

13. The control method for controlling the image display apparatus according to claim 12, wherein the size of the light emission control block of the light emitting unit corresponding to the first display area is decreased in a stepwise manner as time elapses, in the setting step.

14. The control method for controlling the image display apparatus according to claim 12, wherein the size of the light emission control block corresponding to the first display area is set to a predetermined size by the setting step, the predetermined size of the light emission control block corresponding to the first display area is thereafter maintained as time elapses, in the setting step, and the size of the light emission control block corresponding to the second display area is decreased as time elapses, in the setting step.

15. The control method for controlling the image display apparatus according to claim 11, further comprising an area determining step of determining whether or not the plurality of display areas, among which the amount of motion mutually differs, are present in the image to be displayed on the image display apparatus, on the basis of attached information of the image data.

16. The control method for controlling the image display apparatus according to claim 9, wherein the amount of motion of the image is a number of pixels in which pixel values of the image data are changed between two temporally adjoining frames of the image, or a sum total of magnitudes of motion vectors of the image data in relation to the two temporally adjoining frames.

* * * * *